US010025251B2

(12) United States Patent
Tsuji et al.

(10) Patent No.: US 10,025,251 B2
(45) Date of Patent: Jul. 17, 2018

(54) IMAGE FORMING APPARATUS AND SHEET ACCOMMODATION UNIT

(71) Applicant: CANON KABUSHIKI KAISHA, Tokyo (JP)

(72) Inventors: Hiroharu Tsuji, Numazu (JP); Masayoshi Fukatsu, Suntou-gun (JP); Yohei Suzuki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/726,946

(22) Filed: Oct. 6, 2017

(65) Prior Publication Data

US 2018/0039216 A1 Feb. 8, 2018

Related U.S. Application Data

(62) Division of application No. 15/192,559, filed on Jun. 24, 2016, now Pat. No. 9,817,354.

(30) Foreign Application Priority Data

Jun. 29, 2015 (JP) ..... 2015-130484
Jun. 29, 2015 (JP) ..... 2015-130485

(51) Int. Cl.

| | |
|---|---|
| ***G03G 15/00*** | (2006.01) |
| ***B65H 29/58*** | (2006.01) |
| ***B65H 29/22*** | (2006.01) |
| ***B65H 43/00*** | (2006.01) |
| ***B65H 31/24*** | (2006.01) |

(52) U.S. Cl.
CPC ..... *G03G 15/6529* (2013.01); *B65H 29/22* (2013.01); *B65H 29/58* (2013.01); *B65H 31/24* (2013.01); *B65H 43/00* (2013.01); *G03G 15/6552* (2013.01); *G03G 2215/00421* (2013.01); *G03G 2215/00907* (2013.01)

(58) Field of Classification Search
CPC ..... G03G 15/6529; G03G 15/6552; G03G 2215/00907; G03G 2215/00421; B65H 31/24; B65H 43/00; B65H 29/58; B65H 29/22; B65H 29/60; B65H 31/30; B65H 31/3081; B65H 33/14
See application file for complete search history.

(56) References Cited

U.S. PATENT DOCUMENTS 9,541,875 B2 * 1/2017 Sugaya ..... B41J 13/0036
2004/0085565 A1 * 5/2004 Owen ..... G06Q 10/06 358/1.14

(Continued)

*Primary Examiner* — David H Bollinger
(74) *Attorney, Agent, or Firm* — Canon U.S.A., Inc. IP Division

(57) ABSTRACT

An image forming apparatus includes a main body of the image forming apparatus with an opening portion, an image forming unit, an accommodation portion, a stack portion, a sheet moving unit, and a control unit that controls switching between a first mode that moves, with the sheet moving unit, a sheet accommodated in the accommodation portion and stops the sheet when a part of the sheet is exposed external to the main body of the image forming apparatus from the opening portion, and a second mode that moves the sheet, with the sheet moving unit, accommodated in the accommodation portion and that discharges the sheet to the stack portion.

8 Claims, 31 Drawing Sheets

(56) References Cited

U.S. PATENT DOCUMENTS

| | | | | |
|---|---|---|---|---|
| 2009/0041482 | A1* | 2/2009 | Inenaga | G03G 15/6547 399/23 |
| 2015/0078797 | A1* | 3/2015 | Hirose | B65H 39/02 399/405 |
| 2015/0086225 | A1* | 3/2015 | Sugaya | G03G 15/6552 399/23 |
| 2015/0117924 | A1* | 4/2015 | Fujikawa | G03G 15/6552 399/389 |
| 2015/0291375 | A1* | 10/2015 | Tsuji | G03G 15/6552 271/9.04 |
| 2015/0298931 | A1* | 10/2015 | Osaki | B65H 43/00 271/265.01 |
| 2015/0298934 | A1* | 10/2015 | Tsuji | B65H 31/24 271/3.19 |
| 2015/0301490 | A1* | 10/2015 | Takahashi | G03G 15/5016 399/405 |
| 2015/0307295 | A1* | 10/2015 | Takahashi | B65H 31/24 358/1.15 |
| 2016/0378045 | A1* | 12/2016 | Tsuji | G03G 15/6529 271/298 |

* cited by examiner

IMAGE FORMING APPARATUS AND SHEET ACCOMMODATION UNIT

CROSS-REFERENCE TO RELATED APPLICATIONS

This application is a divisional of U.S. patent application Ser. No. 15/192,559, filed Jun. 24, 2016, which claims the benefit of Japanese Patent Application No. 2015-130484, filed Jun. 29, 2015, and Japanese Patent Application No. 2015-130485, filed Jun. 29, 2015, and all of which are hereby incorporated by reference herein in their entirety.

BACKGROUND

Field

The present disclosure relates to an image forming apparatus and a sheet accommodation unit, which includes an accommodation portion that temporarily accommodates a sheet on which an image has been formed.

Description of the Related Art

Hitherto, there are image forming apparatuses, such as copiers and printers, which are provided with accommodation portions that temporarily accommodate sheets inside a main body of the apparatus so that a user can take out only his/her own sheets on which images have been formed.

Japanese Patent Laid-Open No. 2014-114164 describes an image forming apparatus provided with, other than a typical discharge tray that is provided on an upper surface of a main body of the apparatus and that a plurality of users share and use, a plurality of accommodation portions that temporarily accommodate sheets, on which images have been formed, inside a main body of the apparatus. In order to take out the sheets accommodated in the accommodation portion, user authentication is performed with an ID card, for example. The user authentication is performed by having an ID card of the user be read by an ID card reader provided in the apparatus. When the user is authenticated, the sheets of the user who commanded the sheets to be taken out are exposed external to the main body of the apparatus. With the above, the user can take out only his/her own sheets on which images have been formed and does not have to go through the trouble of finding his/her own sheets from a discharge tray on which own sheets and sheets of other users are mixed.

In the image forming apparatus of Japanese Patent Laid-Open No. 2014-114164, when the user is authenticated, the sheets accommodated in the accommodation portion are moved and the sheets are stopped when portions of the sheets are exposed external to the main body of the apparatus from an opening portion. With the above, the user is capable of removing the user's own sheets. However, there are cases in which the above method of removing sheets does not match the needs of the user.

A configuration, such as the configuration of Japanese Patent Laid-Open No. 2014-114164, in which the accommodation portion is provided inside the main body of the apparatus has an upper limit in the number of sheets that can be accommodated in the accommodation portion. Furthermore, user authentication with an ID card is needed when taking out sheets that are accommodated in the accommodation portion, and the sheets cannot be taken out by a user other than the user that had commanded the printing of the sheets. Accordingly, when all of the accommodation portions are accommodated with sheets, a state in which other users cannot use the accommodation portion continues while the user forgets to take out the sheets from the accommodation portion.

SUMMARY

According to the present disclosure, the time period until other users can use the accommodation portion is shortened when the accommodation portions are accommodated with sheets. This results in usability improvement.

In order to improve usability, an image forming apparatus of the present disclosure includes a main body of the image forming apparatus including an opening portion, an image forming unit that forms an image on a sheet, an accommodation portion that accommodates, inside the main body of the image forming apparatus, the sheet on which an image has been formed with the image forming unit, a stack portion that stacks the sheet discharged external to the main body of the image forming apparatus, a sheet moving member that moves the sheet accommodated in the accommodation portion, and a control unit that controls switching between a first mode that moves, with the sheet moving member, the sheet accommodated in the accommodation portion and stops the sheet when a part of the sheet is exposed external to the main body of the apparatus from the opening portion, and a second mode that moves the sheet, with the sheet moving member, accommodated in the accommodation portion and that discharges the sheet to the stack portion.

Further features of aspects of the present invention will become apparent from the following description of exemplary embodiments with reference to the attached drawings.

DESCRIPTION OF THE EMBODIMENTS

Hereinafter, exemplary embodiments of the present disclosure will be described in detail with reference to the drawings.

Block Diagram of Image Forming Apparatus

Figure 1:
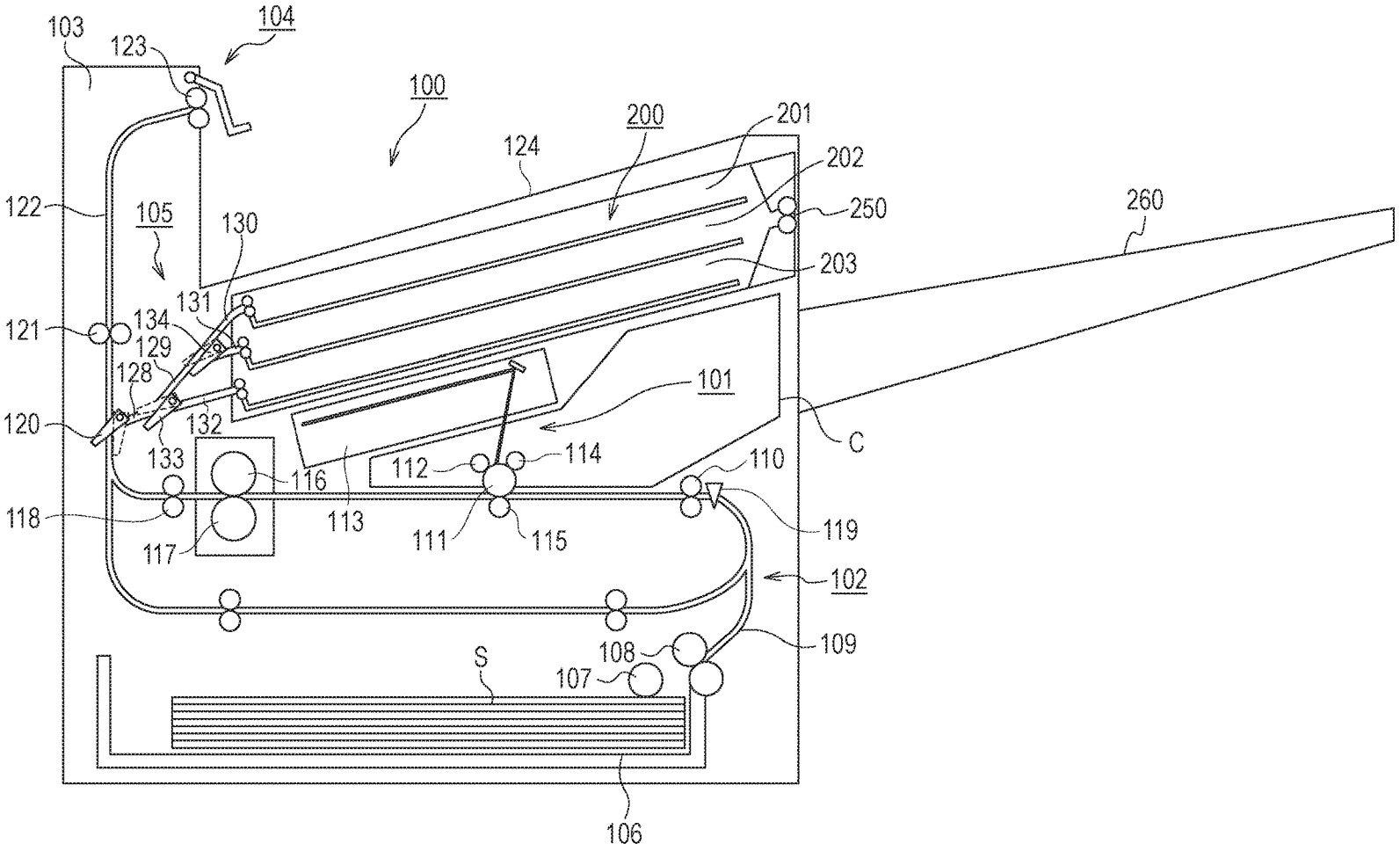
FIG. 1 is a cross-sectional view illustrating a configuration of an image forming apparatus according to a first exemplary embodiment.

FIG. 1 is a cross-sectional view of an image forming apparatus 100 provided with accommodation portions according to the first exemplary embodiment of the present disclosure. Note that in the present exemplary embodiment, a laser beam printer is illustrated as an example of the image forming apparatus.

The apparatus 100 includes an image forming unit 101, a supply unit 102 that supplies a sheet S to the image forming unit 101, a main body 103 (also referred to as a housing) of the apparatus, and a discharge unit 104 that discharges the sheet S on which an image has been formed with the image forming unit 101. Note that the sheet S is a sheet on which an image is formed with the image forming unit 101 and includes a piece of recording paper (plain paper, thick paper, or thin paper) or an OHP sheet, for example. Furthermore, the apparatus 100 includes a sheet accommodation unit 200 provided with a plurality of sheet accommodation portions 201 to 203 that temporarily accommodate sheets S on which images have been formed. Furthermore, the apparatus 100 includes a conveyance unit 105 that sorts and conveys the sheets S on which images have been formed to the accommodation portions 201 to 203 of the unit 200. Furthermore, the apparatus 100 includes a discharge tray 260 on which the sheets S discharged external to the main body 103 of the apparatus are stacked. The discharge tray 260 will be described in detail later.

The image forming unit 101 includes a photosensitive drum 111 that rotates clockwise (in a CW direction) in FIG. 1, a charge roller 112 that charges the surface of the drum 111, and an exposure unit 113 that forms an electrostatic latent image by irradiating the drum 111 with light. Furthermore, the image forming unit 101 includes a development unit 114 that adheres toner onto the electrostatic latent image and forms a toner image on the drum 111, and a transfer roller 115 that transfers toner image on the sheet S that has been conveyed. Furthermore, the image forming unit 101 includes a fixing roller 116, a pressure roller 117 that abuts against the roller 116, and a discharge roller 118, and fixes the toner image transferred onto the sheet S to the sheet S. The image forming unit 101 forms a toner image on the sheet S through the above electrophotographic image forming process.

Note that in the apparatus 100 of the present exemplary embodiment, the drum 111, the roller 112, the unit 114, and a toner accommodation portion (not shown) that accommodates toner are integrated as a cartridge C. The cartridge C is detachable with respect to the main body 103 of the apparatus. When there is no toner left in the cartridge C, the user can replace the cartridge C with a new cartridge C. With the above, the user can perform maintenance of the apparatus 100 without a service person. Furthermore, the present disclosure is not limited to such a cartridge type apparatus 100, and may be applied to an apparatus having a configuration in which members such as the drum 111, the roller 112, and the unit 114 are installed in the main body 103 of the apparatus (an apparatus in which the replacement of the components is not required).

The supply unit 102 includes a supply cassette 106 in which a plurality of sheets S used to form images are contained in a stacked state, a pickup roller 107, a feed roller 108, a conveyance guide 109, and a registration roller 110.

Furthermore, a registration sensor 119 is provided near the roller 110. In response to the detection of the sensor 119 detecting the front edge of the conveyed sheet S, a timing to start forming an image with the image forming unit 101 is determined. The sensor 119 is constituted by a flag and a photo-interrupter (both not shown). The sensor 119 is configured so that an on/off signal is output from the photo-interrupter upon activation of the flag activated by the conveyed sheet.

The discharge unit 104 includes a first switching member 120, a conveyance roller 121, a discharge guide 122, a discharge roller 123, and a discharge tray 124. The switching member 120 is capable of switching, with an actuator (not shown), between a position indicated by a solid line in FIG. 1 that guides the sheet S after image forming to the unit 200, and a position indicated by a broken line that guides the sheet S after image forming to the tray 124. The tray 124 is provided on an upper surface of the main body 103 of the apparatus and may be used and shared by a plurality of users. The sheet S is discharged on the tray 124 with the surface on which the image has been formed facing downwards (face-down).

The conveyance unit 105 includes a second switching member 133 and a third switching member 134 for switching the conveyance destination of the sheet S, and conveyance guides 128 to 132 that guides the sheets S to their respective accommodation portions 201 to 203. Note that the switching member 133 and the switching member 134 are capable of switching, with an actuator (not shown), between positions depicted by solid lines in FIGS. 1, and positions depicted by broken lines. For example, when the sheet S is conveyed to the accommodation portion 201, the switching member 133 and the switching member 134 are positioned at positions illustrated by solid lines in FIG. 1. The sheet S sequentially passing through the guides 128, 129, and 130 is conveyed to the accommodation portion 201. Furthermore, when the sheet S is conveyed to the accommodation portion 202, the switching member 134 alone is switched to the position illustrated by the broken line. In the above case, the sheet S sequentially passing through the guides 128, 129, and 131 is conveyed to the accommodation portion 202. Note that similar to the tray 124, the sheets S are accommodated in the accommodation portions 201 to 203 facedown.

Block Diagram of Sheet Accommodation Unit

Figure 2:
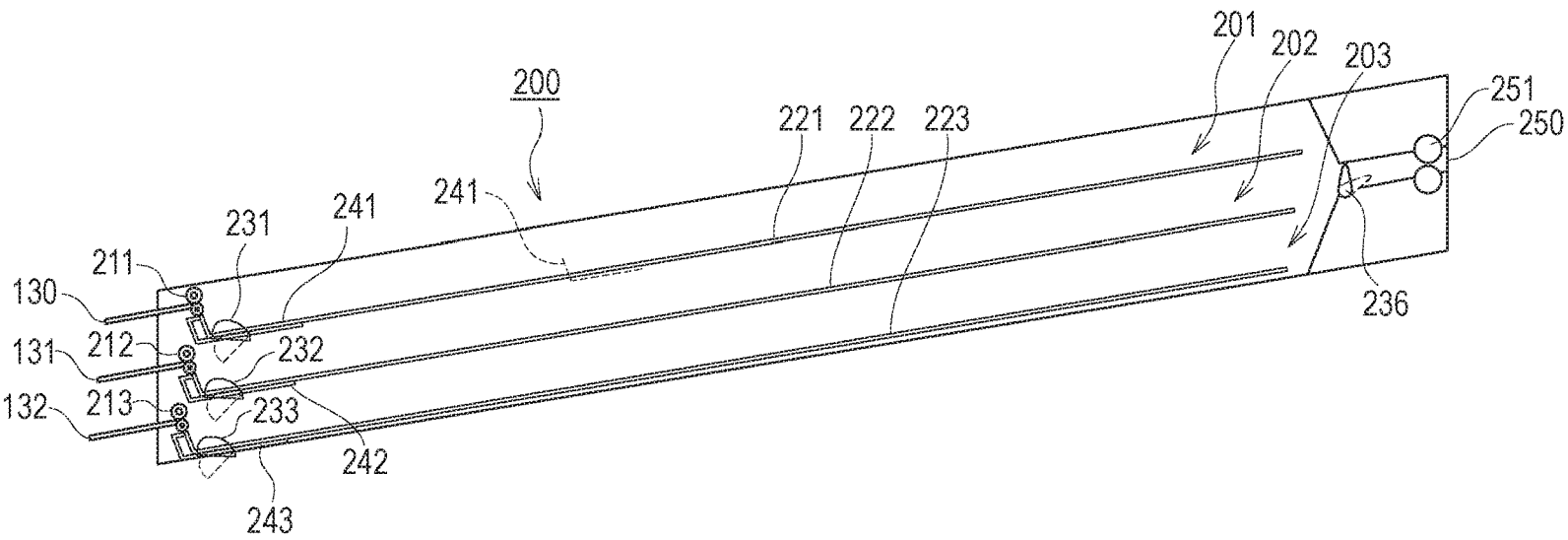
FIG. 2 is a cross-sectional view illustrating a configuration of a sheet accommodation unit according to the first exemplary embodiment.

FIG. 2 is a cross-sectional view illustrating a configuration of the unit 200. In the unit 200 of the present exemplary embodiment, the plurality of accommodation portions 201 to 203 are disposed so as to be stacked in the vertical direction. The configuration of each accommodation portion is the same and, herein, the configuration of the accommodation portion 201 will be mainly described.

The accommodation portion 201 includes conveyance rollers 211 for conveying the sheet S, a stacking tray 221 for stacking and temporarily accommodating the sheet S inside the main body 103 of the apparatus, and a sheet presence detection sensor 231 that detects whether a sheet S or sheets S are accommodated in the tray 221. Furthermore, the accommodation portion 201 includes a sheet push out member 241 that pushes the rear edge of the sheet S (the edge part of the sheet S on the upstream side in the conveyance direction) that is accommodated therein and that exposes a part of the accommodated sheet S to the outside of the main body 103 of the apparatus. The push out member 241 moves the sheet S to a position that the user can receive the sheet S, in other words, the push out member 241 moves the sheet S until the front edge (the edge part of the sheet S on the downstream side in the conveyance direction) passes an opening portion 250. The opening portion 250 is formed in the main body 103 of the apparatus. With the above, a predetermined length of the sheet S can be exposed outside the main body 103 of the apparatus. Furthermore, discharge roller pairs 251 in which the rollers of each discharge roller pairs are capable of abutting against or separated from each other with an actuator (not shown) are disposed immediately upstream of the opening portion 250. FIG. 2 illustrates a state in which the rollers of each roller pair 251 are abutted against each other. When the sheet S is moved with the push out member 241 and is exposed from the opening portion 250, the rollers of each roller pair 251 are separated from each other. The role of the roller pairs 251 will be described in detail later. Note that the length in which the sheet S is exposed external to the main body 103 of the apparatus is set to 30 mm in the present exemplary embodiment. The above predetermined length is an example and any length that enables the user to take hold of the exposed sheet S and in which the sheet S is not greatly bent may be set.

Furthermore, the length of the tray 221 is set so that even if a sheet S with the maximum size that can be accommodated in the accommodation portion 201 is stacked, the front edge of the sheet S does not become exposed from the opening portion 250. When a sheet S is stacked on the tray 221 and the stacked sheet S pushes down the sensor 231 to the position depicted by a broken line, the sensor 231 is turned on. When the push out member 241 moving the sheet S returns the sensor 231 to the position depicted by a solid line, the sensor 231 is turned off. Furthermore, when an opening portion sensor 236 that is disposed near the opening portion 250 is pushed to the position depicted by a broken line by the front edge of the moved sheet S, the sensor 236 is turned on. When the sheet S exposed external to the main body 103 of the apparatus is removed and the sensor 236 returns to the position depicted by a solid line, the sensor 236 is switched off from on. When the sheets S are continuously conveyed to the accommodation portion 201, the push out member 241 is positioned at a stack position illustrated by a solid line. On the other hand, when exposing the accommodated sheet S, the push out member 241 moves towards the opening portion 250 in the conveyance direction of the sheet S so as to be capable of being moved to the exposure position illustrated by a broken line. The position of the exposure position, in other words, the distance in which the push out member 241 is moved, is determined by the length the sheet S is exposed and the size of the sheet S in the conveyance direction.

Figure 3:
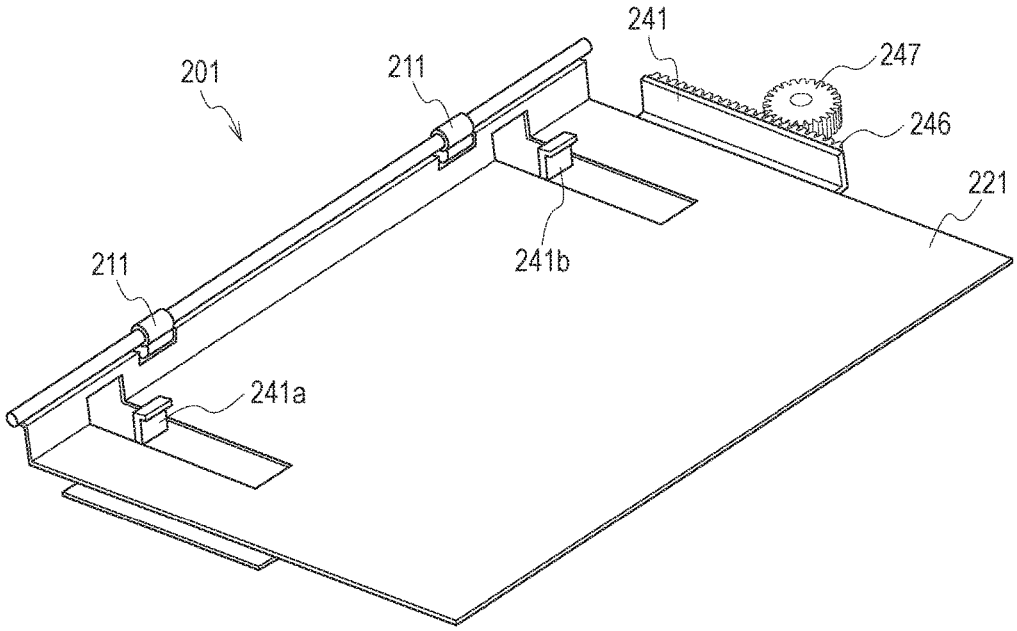
FIG. 3 is a perspective view of a sheet accommodation unit according to the first exemplary embodiment.

FIG. 3 is a perspective view of the accommodation portion 201. In FIG. 3, the push out member 241 is positioned between the stack position and the exposure position. The push out member 241 includes two push out claws 241*a* and 241*b* in the width direction of the sheet S. Furthermore, the push out member 241 includes a rack 246 in an integrated manner. The rack 246 meshes with the pinion 247. In FIG. 3, the pinion 247 is connected to an actuator that is a drive member (not shown). By driving the actuator in a normal direction or in a reverse direction, the push out member 241 can be reciprocated between the stack position and the exposure position.

The configuration of the accommodation portion 202 and that of the accommodation portion 203 are the same as that of the accommodation portion 201. In other words, the accommodation portion 202 includes conveyance rollers 212, a stacking tray 222, a sheet presence detection sensor 232, and a sheet push out member 242. Furthermore, the accommodation portion 203 includes conveyance rollers 213, a stacking tray 223, a sheet presence detection sensor 233, and a sheet push out member 243.

Block Diagram of Control Unit and Functional Components

Figure 4:
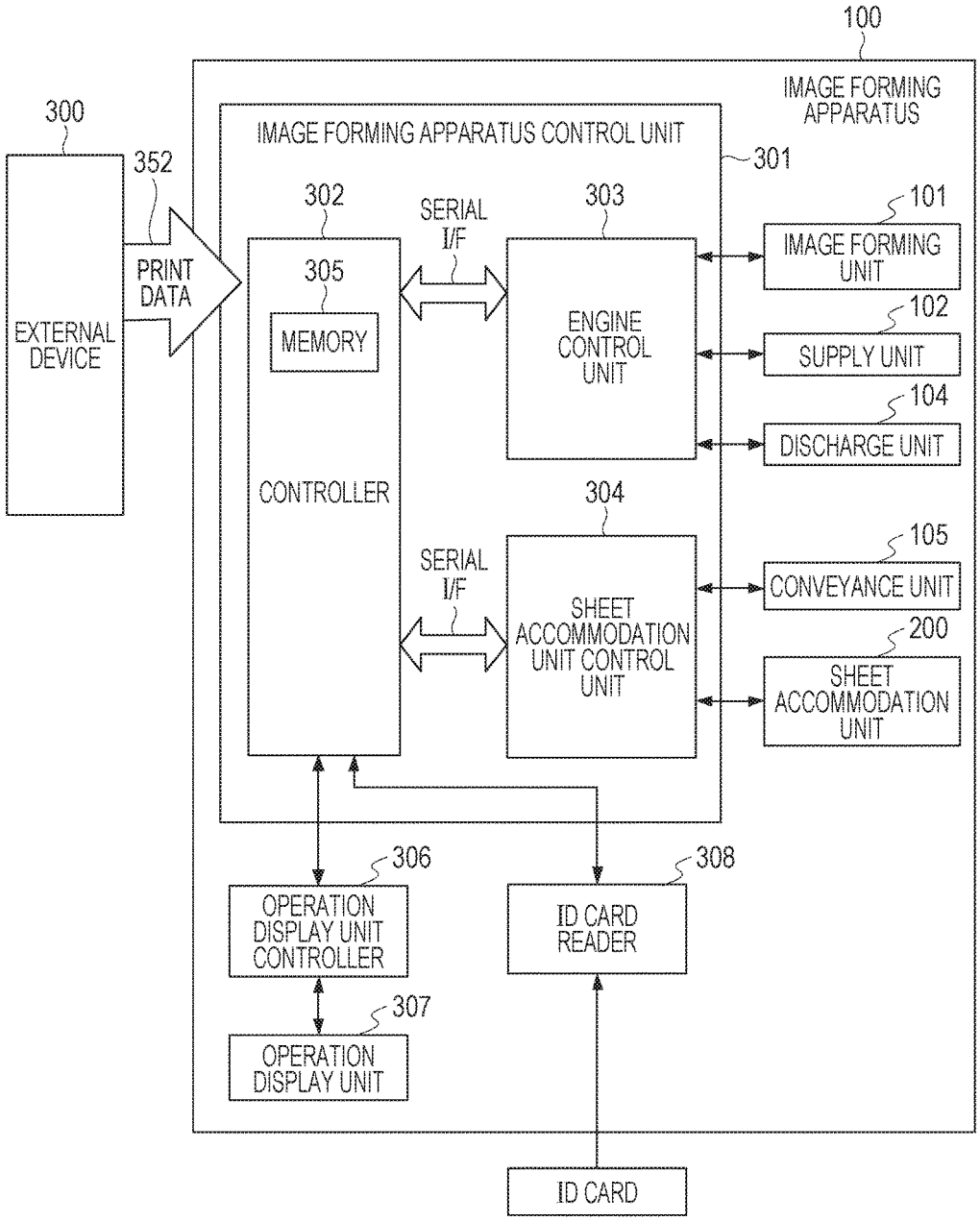
FIG. 4 is a block diagram illustrating a control unit and functional components of the image forming apparatus according to the first exemplary embodiment.

FIG. 4 is a block diagram illustrating a control unit and functional components of the present exemplary embodiment. The apparatus 100 includes an image forming apparatus control unit 301 serving as a control unit. The control unit 301 includes a controller 302, an engine control unit 303, and a sheet accommodation unit control unit 304. Furthermore, the above control units each include a CPU.

The controller 302 communicates with an external device 300, such as a host computer, receives print data 352, and stores the received print data 352 in a memory 305 (a RAM, a ROM, or the like). The controller 302 creates print conditions by analyzing the print data 352 stored in the memory 305. The print conditions are pieces of information indicting the number of sheet S to supply, the conveyance destination (the tray 124 or the unit 200) of the sheet S on which the image has been formed, the density of the printed image, and the like. Furthermore, the controller 302 specifies, to the control unit 303, the print conditions formed from the data 352 through a serial I/F. The control unit 303 controls each mechanism according to the print conditions received from the controller 302. Specifically, the image forming unit 101 is controlled to form an image on the sheet S, and the supply unit 102 and the discharge unit 104 are controlled to supply and discharge the sheet S.

Furthermore, the controller 302 analyzes the data 352 stored in the memory 305 and creates accommodation conditions and moving conditions of the accommodation portions 201 to 203. Furthermore, the controller 302 specifies, to the control unit 304, the accommodation conditions and the moving conditions formed from the data 352 through a serial I/F. The accommodation conditions are pieces of information on the destiny of accommodation of the sheets, the number of sheets S accommodated, and the like. Furthermore, the moving conditions are pieces of information on the distance in which the push out members 241 to 243 are moved to expose the sheet S from the opening portion 250, and the like. The control unit 304 controls each mechanism according to the accommodation conditions and the moving conditions received from the controller 302. Specifically, the conveyance unit 105 is controlled to convey the sheets S on which images have been formed to the accommodation portions 201 to 203, and the unit 200 including the push out members 241 to 243 is controlled to move the sheets S accommodated in the accommodation portions 201 to 203 to the opening portion 250. Furthermore, an operation display unit controller 306 performs control of notifying, to the controller 302, various settings and expose command (move command) set by a user through the operation display unit 307. The operation display unit 307 functions as an input member capable of externally inputting information related to the users (ID numbers of the users and passwords of the users, for example). An ID card reader 308 notifies, to the controller 302, pieces of user information obtained from ID cards. As described above, the ID card reader 308 also functions as an input member that is capable of externally inputting pieces of information related to the users.

Description of Operation of Sheet Accommodation Unit

Figure 5:
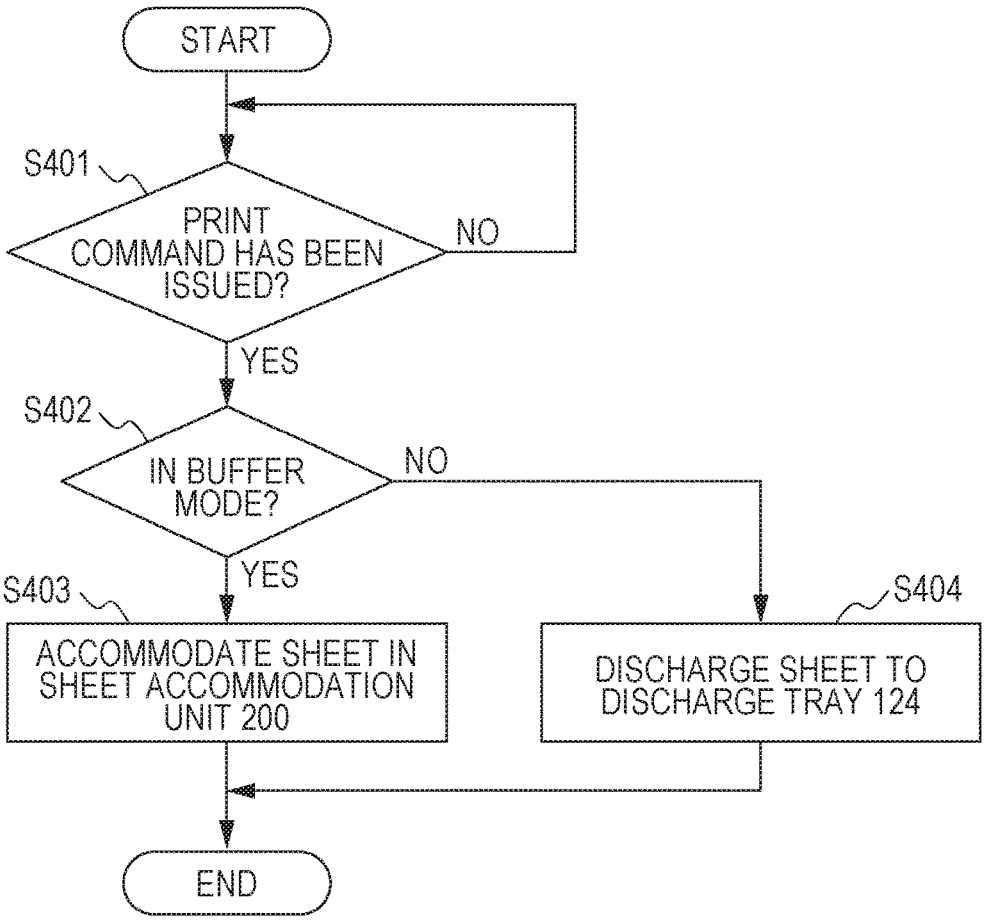
FIG. 5 is a flowchart for printing the sheets, according the first exemplary embodiment.

In the apparatus 100 described above, the user is capable of selecting, with the external device 300 or the operation display unit 307, either one of a buffer mode in which the sheet S is temporarily accommodated in the unit 200 and a normal mode in which the sheet S is discharged to the tray 124. The selected mode is stored in the memory 305. FIG. 5 is a chart illustrating a flow when the user commands printing of the sheet S. Note that the control based on the above flowchart is executed by the controller 302 and the like described in FIG. 4 on the basis of a program stored in the memory 305.

First, when the user commands printing of the sheet S through the external device 300, the data 352 is transmitted to the controller 302 (S401). Upon reception of the data 352, the controller 302 refers to the information stored in the memory 305 and confirms whether the buffer mode has been selected (S402). When the buffer mode has been selected, the controller 302 temporarily accommodates the sheet S in the unit 200 (S403). When the normal mode has been selected, the controller 302 discharges the sheet S to the tray 124 (S404). With the above, the control illustrated in the present flowchart ends. In the flowchart in FIG. 5, the mode is, as a prerequisite, selected by the user in advance; however, the present disclosure is not limited to the above. For example, the user may select in which mode the printing is to be operated each time the user commands printing.

When accommodating the sheets S in the unit 200, the sheets S are sorted to the accommodation portions 201 to 203 according to a predetermined rule. In the present exemplary embodiment, the sheets S are sorted to different accommodation portions based on job numbers of the sheets S. Furthermore, when exposing the sheet S from the unit 200, the sheet S of the user who commanded the exposure of the sheet S is exposed external to the main body 103 of the apparatus from the opening portion 250. The user can issue an expose command by inputting a preset password to the external device 300 or the operation display unit 307. Alternatively, the ID card of the user can be read by the ID card reader 308 to perform user authentication and issue an expose command. In the present exemplary embodiment, as described above, actuators that drive the push out members 241 to 243 are each provided for the corresponding accommodation portions 201 to 203. Accordingly, even if sheets S of the same user are accommodated in plurality of accommodation portions, by driving each of the respective actuators, the user can receive the sheets S all at once. Furthermore, pieces of information, such as the job number of the sheet S and the user who commanded the printing of the sheet S, are stored in the memory 305 provided in the controller 302. In accordance with the expose command issued by the user, the controller 302 refers to the memory 305 and specifies the sheet S subject to the exposure and issues an expose command to the unit 200.

Figure 6A:
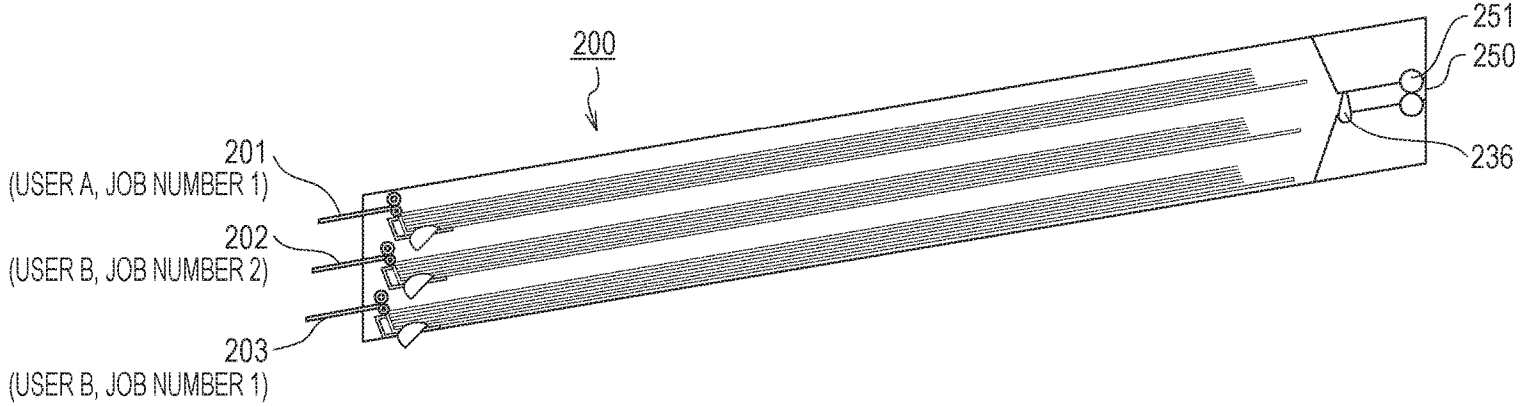
FIGS. 6A and 6B are cross-sectional views of the sheet accommodation unit according to the first exemplary embodiment illustrating a state in which the sheets are exposed.
Figure 6B:
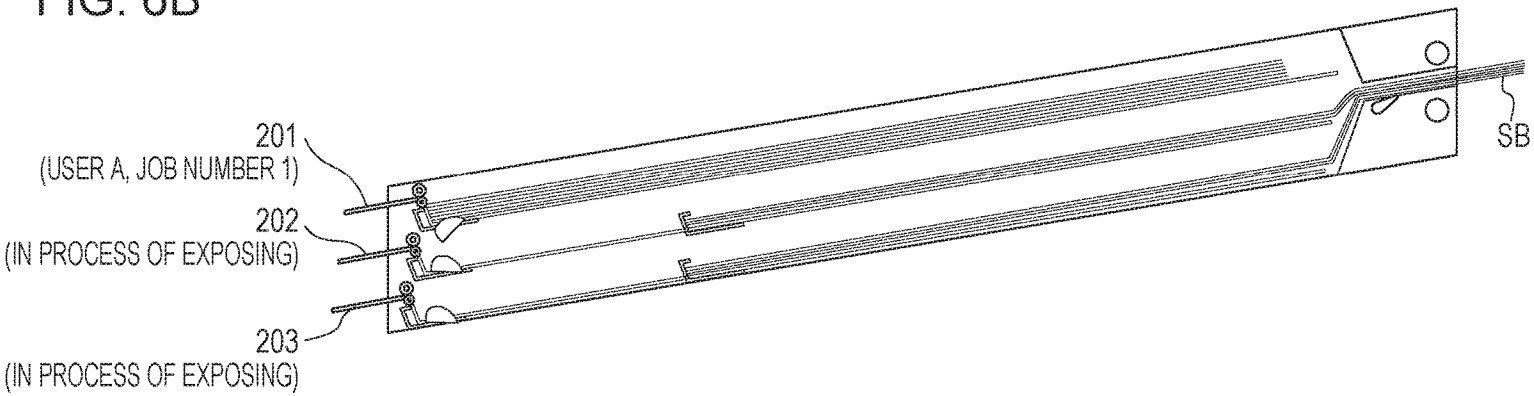

FIGS. 6A and 6B are diagrams illustrating an exemplary operation of the unit 200. In FIG. 6A, sheets S of user A are accommodated in the accommodation portion 201, and sheets S of user B are accommodated in the accommodation portions 202 and 203. Among the sheets S that user B has commanded to print, sheets S with job number 2 are accommodated in the accommodation portion 202 and sheets S with job number 1 are accommodated in the accommodation portion 203. In FIG. 6B, when a command to expose the sheets S of user B is issued, the push out members 242 and 243 are stopped after being moved towards the opening portion 250 such that a stack of sheets SB are exposed from the opening portion 250. In the above, the rollers of each roller pair 251 are separated from each other. As in the above manner, a state in which portions of the sheets S are in the main body 103 of the apparatus and in which the sheets S are exposed external to the main body 103 of the apparatus from the opening portion 250 is defined as an exposed state.

Figure 7:
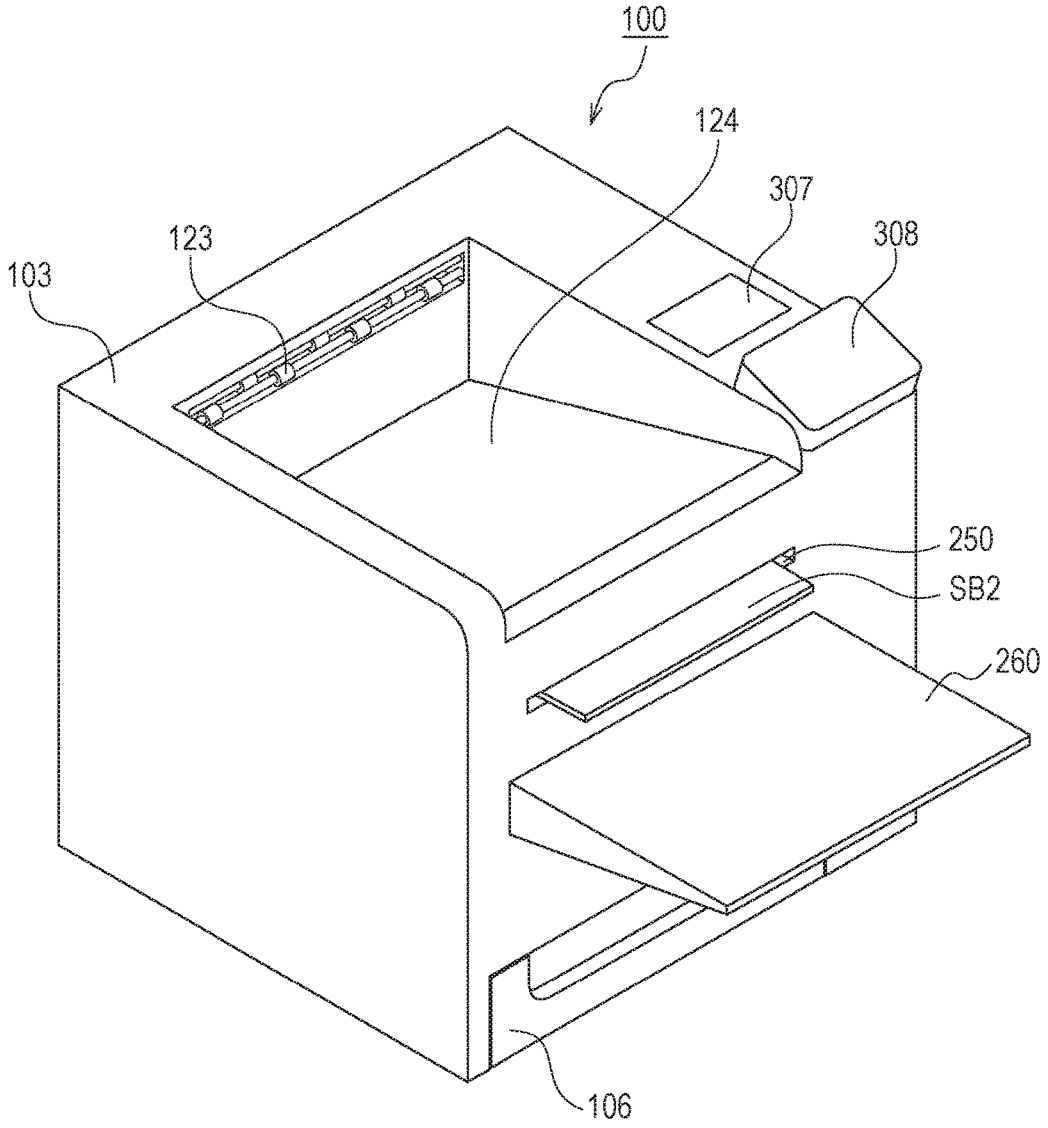
FIG. 7 is a perspective view of the image forming apparatus according the first exemplary embodiment illustrating a state in which the sheets are exposed.

FIG. 7 illustrates a perspective view of the apparatus 100 in the above state. Front edges SB2 of the stacked sheets SB that have been exposed from the accommodation portions 202 and 203 are exposed from the opening portion 250. The user can take out the stack of sheets SB by grabbing and pulling out the front edges SB2 exposed external to the main body 103 of the apparatus.

Note that the periphery of the unit 200 other than where a conveyance opening (not shown) for conveying the sheets S and where the opening portion 250 for exposing the accommodated sheets S are located is surrounded. Furthermore, a member surrounding the peripheral of the unit 200 is made of a non-transparent material. Accordingly, while the sheets S are accommodated in the accommodation portions 201 to 203, information printed on the sheets S in each accommodation portions 201 to 203 cannot be seen by the user. With the above, confidentiality of information can be increased since the information printed on the sheets S cannot be seen by other users.

Meanwhile, from the viewpoint of increasing confidentiality of information, there is an image forming apparatus that starts image forming after user authentication has been performed with an ID card and the like. However, different from such an apparatus, the apparatus 100 of the present exemplary embodiment only has to perform an operation of exposing the sheets s, on which images have been already formed, from the accommodation portions 201 to 203. Accordingly, without waiting while the images are formed after user authentication has been performed, the sheets S can be taken out quickly.

Furthermore, when the user commands the apparatus 100 to expose the sheets S, the user will be capable of only taking out his/her own sheet S. With the above, the user does not have to go through the trouble of finding his/her own sheets S from the tray 124 on which own sheets S and sheets of other users are mixed.

Description of Forced Discharge Mode

A mode that forcibly discharges the sheets S accommodated in the unit 200 in buffer mode external to the main body 103 of the apparatus will be described next. The number of sheets S that can be accommodated in the unit 200 is limited, and when the sheets S are left unattended in the unit 200 for a long period of time due to, for example, the user forgetting to take out the sheets S, the other users will be unable to use the unit 200. Accordingly, in the present exemplary embodiment, when the controller 302 receives a new accommodation command, the sheets S that have been left unattended in the unit 200 for a long period of time are forcibly discharged to the tray 260. Note that an accommodation command indicates a printing command using the buffer mode.

Figure 8:
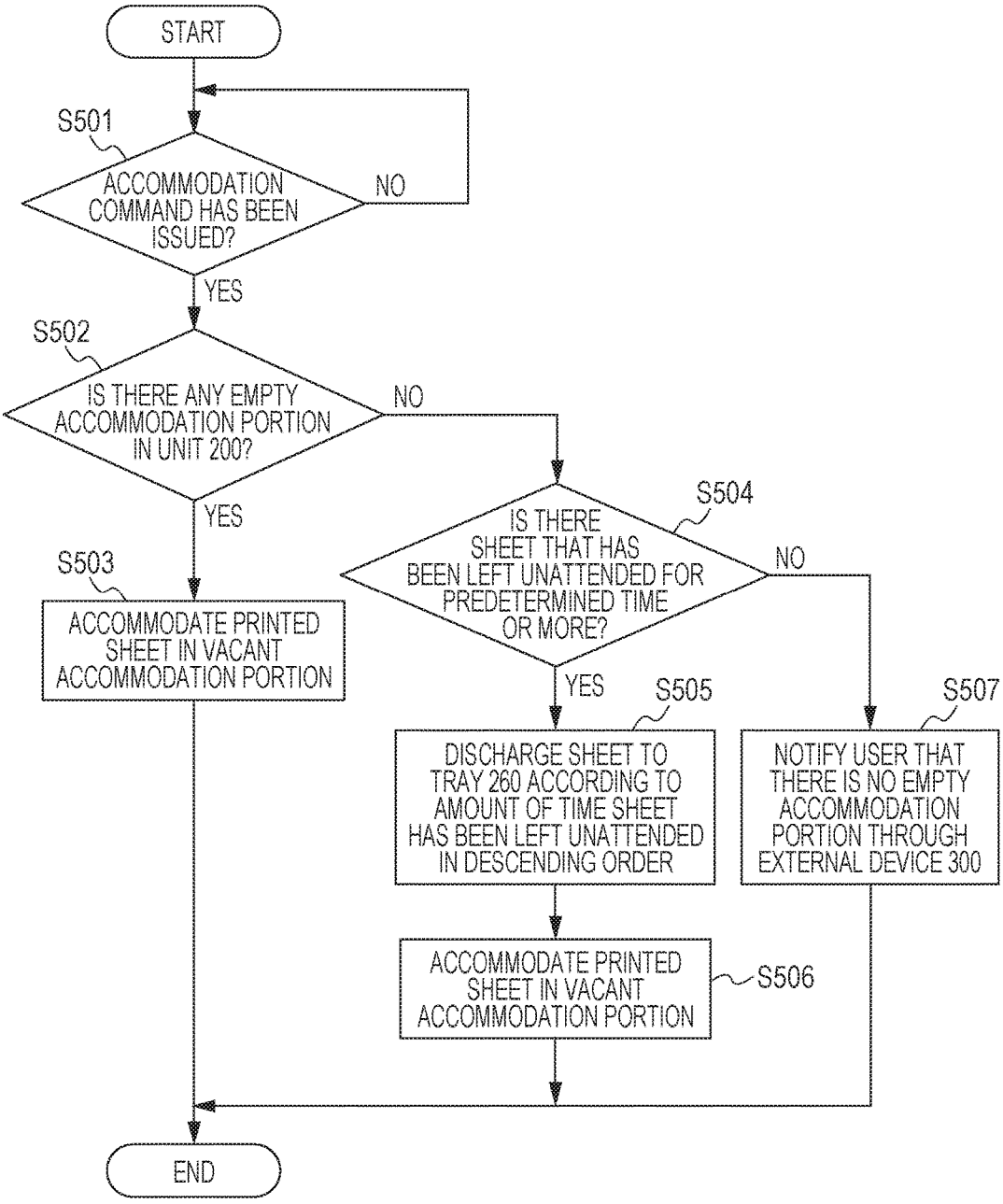
FIG. 8 is a flowchart related to an operation of the first exemplary embodiment.

FIG. 8 illustrates a flowchart of a forced discharge mode according to the present exemplary embodiment. Note that the control according to the flowchart is executed by the controller 302 and the like, illustrated in FIG. 4, based on the program stored in the memory 305.

First, when printing of the sheets S is commanded in buffer mode, the accommodation command is issued to the controller 302 (S501). The controller 302 determines whether there is any empty accommodation portion in the plurality of accommodation portions 201 to 203 included in the unit 200 (S502). When there is an empty accommodation portion, the controller 302 starts a new sheet S printing process and conveys the sheets S to the empty accommodation portion with the conveyance unit 105 (S503).

Conversely, when there is no empty accommodation portion, the controller 302 determines whether there are sheets S that have been left unattended for a predetermined period of time (30 minutes, for example) or more in the unit 200 (S504). The predetermined period of time may be allowed to be set optionally by the user with the operation display unit 307 or the like. When there are sheets S that have been left unattended for the predetermined period of time or more, the controller 302 discharges the sheets S to the tray 260 according to the amount of time the sheets S have been left unattended in descending order (S505). In other words, the discharge of the sheets S external to the main body 103 of the apparatus is started from the sheets S in the accommodation portion accommodating the sheets S in which the unattended time period is the longest. With the above, an empty accommodation portion can be created in the unit 200. Note that the user that had commanded the printing of the sheets S may be notified through the external device 300 that the sheet S has been forcibly discharged. Subsequently, the controller 302 starts a new sheet S printing process and conveys the sheets S to the empty accommodation portion with the conveyance unit 105 (S506).

When there is no sheet S that has been left unattended for the predetermined period of time or more, the controller 302 notifies the user who has issued the print command that there is no empty accommodation portion in the unit 200 through the external device 300 (S507). At this point, the user may select to switch the buffer mode to the normal mode and have the sheets S discharged to the tray 124. Alternatively, the sheets S may automatically be made to be discharged to the tray 124, and the information notified in S507 may be information that the conveyance destination (the destination of the discharge) of the sheets S has been changed.

Figure 9A:
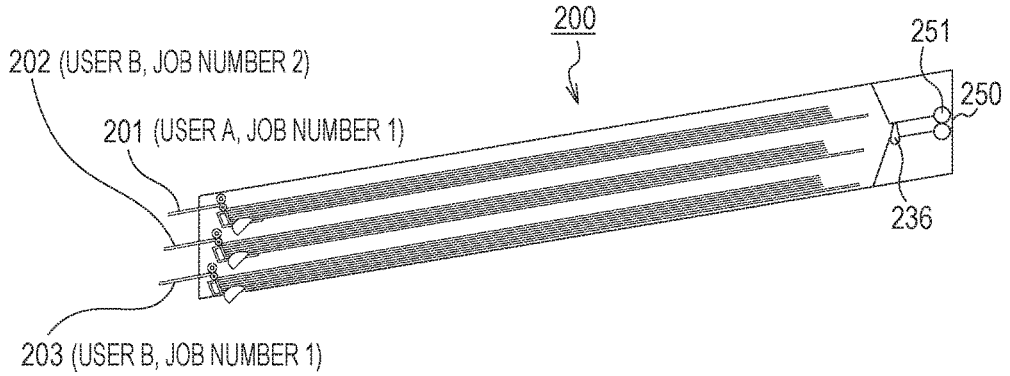
FIGS. 9A to 9C are cross-sectional views of the sheet accommodation unit according to the first exemplary embodiment illustrating a state in which the sheets are forcibly discharged.
Figure 9B:
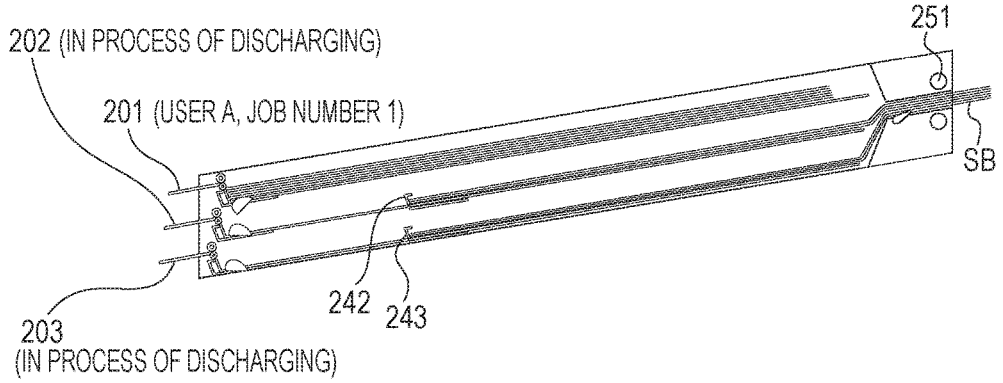
Figure 9C:
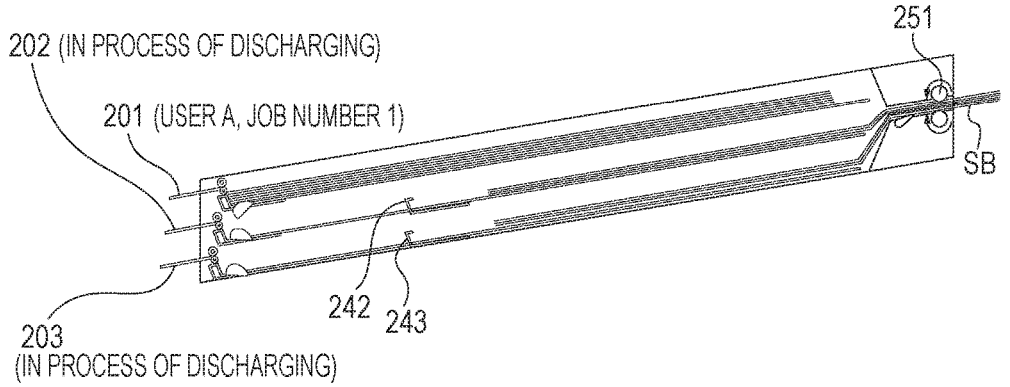
Figure 10:
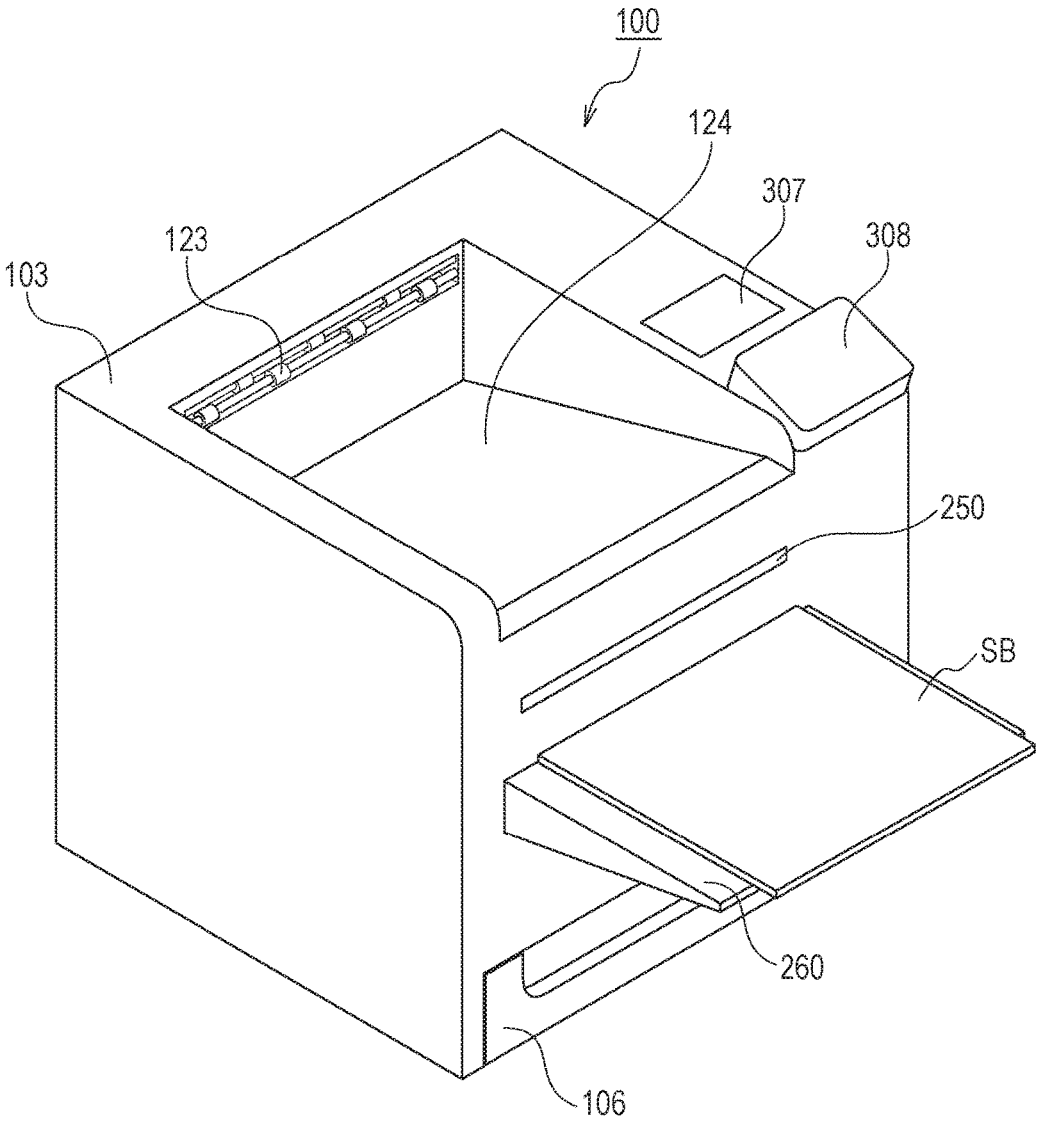
FIG. 10 is a perspective view of the image forming apparatus according the first exemplary embodiment illustrating a state in which the sheets are forcibly discharged.

The operation of forcibly discharging the sheets S to the tray 260 will be described with reference to FIGS. 9A to 9C and 10. FIGS. 9A to 9C are diagrams illustrating an exemplary operation of the unit 200, and FIG. 10 is a perspective view of the apparatus 100 when the sheets S are discharged to the tray 260.

FIG. 9A illustrates the same state as the state illustrated in FIG. 6A, in which sheets S of user A are accommodated in the accommodation portion 201, and sheets S of user B are accommodated in the accommodation portions 202 and 203. In the above, when the sheets S of user B is forcibly discharged to the tray 260, similar to the operation illustrated in FIG. 6B, the rear edges of the sheets S of user B are pushed out with the push out members 242 and 243 (FIG. 9B). In the above, the rollers of the roller pairs 251 are separated from each other and are not rotating. As illustrated in FIG. 9C, after the front edge of the stack of sheets SB passes the opening portion 250 and is in an exposed state, the rollers of each roller pair 251 abuts against the exposed stack of sheets SB. Subsequently, rotation of the roller pairs 251 in the directions of the arrows in the drawing while the roller pairs 251 are abutted against the stack of sheets SB discharges the exposed stack of sheets SB external to the main body 103 of the apparatus. As a result, as illustrated in FIG. 10, the rear edge of the stack of sheets SB passes the opening portion 250, and the stack of sheets SB is discharged to the tray 260. Furthermore, the timing at which the rotation of the roller pairs 251 is stopped may be controlled based on the timing at which the rear edge of the stack of sheets SB is detected by the sensor 236. With the above operation, the accommodation portions 202 and 203 turn into empty accommodation portions such that new sheets S can be accommodated.

As described above, in the present exemplary embodiment, when sheets are accommodating the accommodation portions, the time period until the other users can use the accommodation portions can be made shorter.

Note that in the present exemplary embodiment, a configuration in which the user is notified, through an external device 300, that the sheets S has been forcibly discharged in S505 is described; however, the information may be merely displayed on the operation display unit 307. Furthermore, when the user issues an expose command through the operation display unit 307 or the ID card reader, the operation display unit 307 may display the information on the issuance of the command. Furthermore, the user may be allowed to disable the forced discharge per each job.

Furthermore, in the present exemplary embodiment, the configuration in which the push out members 241 to 243 and the roller pairs 251 are used to discharge the sheets S accommodated in the accommodation portions 201 to 203 to the tray 260 has been described. However, the present disclosure is not limited to the above. Ranges of motion of the push out members 241 to 243 may be increased and the sheets S accommodated in the accommodation portions 201 to 203 may be discharged to the tray 260 with only the push out members 241 to 243.

Furthermore, in the present exemplary embodiment, as illustrated with FIGS. 9A to 9C, an example of forcibly discharging the sheets S accommodated in the accommodation portions 202 and 203 to the tray 260 has been described. However, not limited to the above, naturally, the subject of the forced discharge may be a single accommodation portion. The controller 302 may perform forced discharge of sheets S on the minimum number of accommodation portions needed to accommodate sheets S that are newly conveyed.

Furthermore, in the present exemplary embodiment, as described with the flowchart in FIG. 8, when the controller 302 receives a new accommodation command, the sheets S that have been left unattended in the unit 200 for a long period of time are forcibly discharged to the tray 260. However, the present disclosure is not limited to the above. The determination process of S504 may be omitted, and when the controller 302 receives a new accommodation command, if there is no empty accommodation portion in the unit 200, the sheets S that have been left unattended for a long period of time may be forcibly discharged automatically. With the above, other users will be capable of using the unit 200 at all times.

The first exemplary embodiment describes a control in which, when the controller 302 receives a new accommodation command, the sheets S that has been left unattended in the unit 200 for a long period of time are forcibly discharged to the tray 260. In other words, the timing at which the forced discharge is performed is based on the timing at which a print command (an accommodation command) is issued by another user. In a second exemplary embodiment, a control will be described in which the vacancy of the unit 200 is monitored regularly and forced discharged is automatically performed regardless of whether there is a print command issued by another user. Since the description of the main portions are similar to the description of the first exemplary embodiment, portions that are different from the first exemplary embodiment will be described herein.

Figure 11:
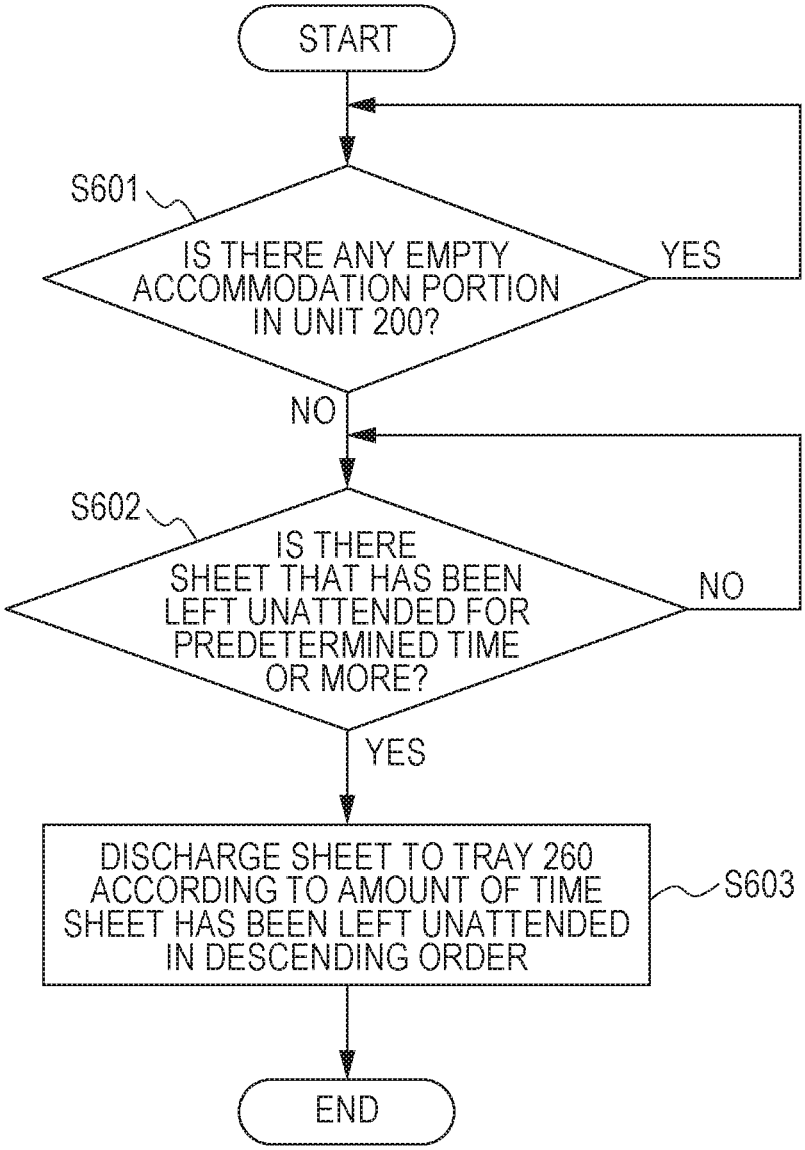
FIG. 11 is a flowchart related to an operation of a second exemplary embodiment.

FIG. 11 illustrates a flowchart of a forced discharge mode according to the present exemplary embodiment. Note that the control according to the flowchart is executed by the controller 302 and the like, illustrated in FIG. 4, based on the program stored in the memory 305.

The controller 302 regularly monitors whether there is any empty accommodation portion in the plurality of accommodation portions 201 to 203 included in the unit 200 (S601). When there is no empty accommodation portion, the controller 302 determines whether there are sheets S that have been left unattended for a predetermined period of time or more in the unit 200 (S602). When there are sheets S that have been left unattended for the predetermined period of time or more, the controller 302 discharges the sheets S to the tray 260 according to the amount of time the sheets S have been left unattended in descending order (S603). In other words, the discharge of the sheets S external to the main body 103 of the apparatus is started from the sheets S in the accommodation portion accommodating the sheets S in which the unattended time period is the longest. With the above, an empty accommodation portion can be created in the unit 200.

In addition to the advantageous effect of the first exemplary embodiment, the present exemplary embodiment described above has the following advantageous effect. While in the first exemplary embodiment, an empty accommodation portion is created after receiving a print command of another user, in the present exemplary embodiment, an empty accommodation portion can be created before receiving a print command. Accordingly, the time for the user to select the buffer mode and to take out own sheets S through the unit 200 can be shortened compared to that of the first exemplary embodiment.

Note that in the present exemplary embodiment, the sheets S that have been left unattended for a predetermined period of time or more are forcibly discharged to the tray 260 after the controller 302 determines whether there is any empty accommodation portion in the unit 200. However, the present disclosure is not limited to the above. The determination process of S601 may be omitted, and when there are sheets S that have been left unattended for a predetermined period of time, regardless of whether there is an empty accommodation portion in the unit 200, the sheets S may be forcibly discharged to the tray 260.

The configurations of the image forming apparatus 100 and the sheet accommodation unit 200 to which the control of the first exemplary embodiment and that of the second exemplary embodiment can be applied are not limited to those described in FIGS. 1 to 3. Hereinafter, other apparatus configurations will be described. Configuration with no discharge tray 260

Figure 12:
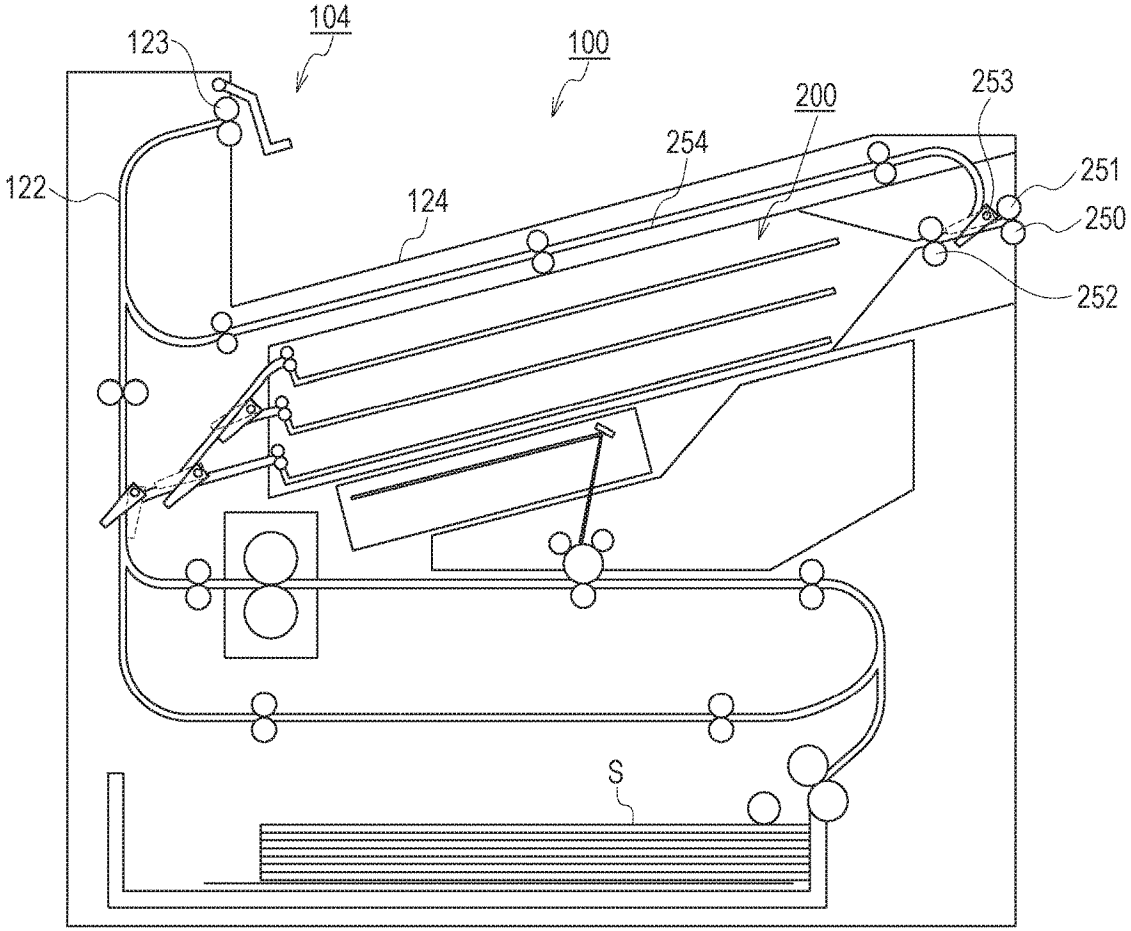
FIG. 12 is a cross-sectional view of an image forming apparatus of the first and second exemplary embodiments having another apparatus configuration.
Figure 13:
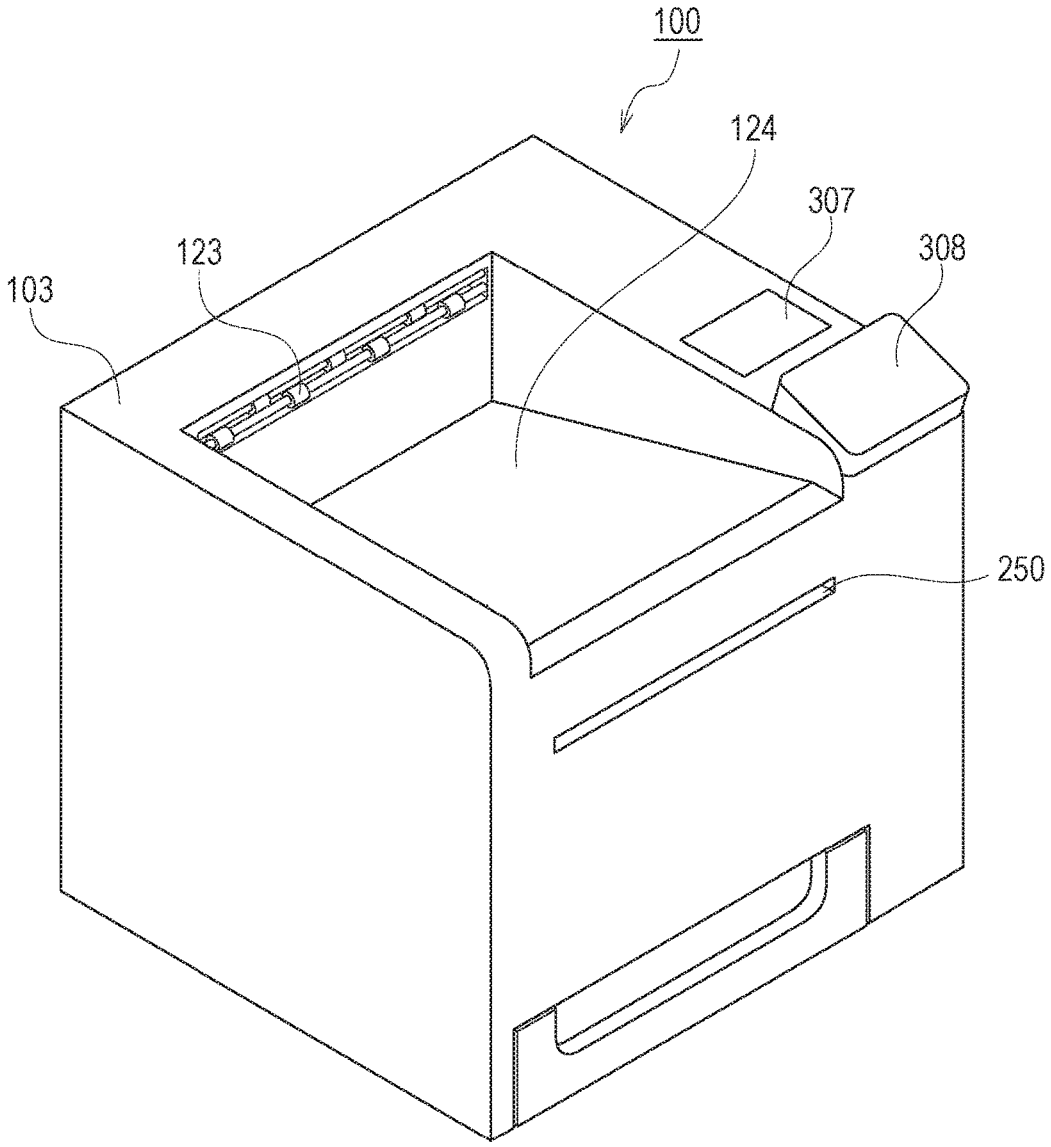
FIG. 13 is a perspective view of the image forming apparatus of the first and second exemplary embodiments having the another apparatus configuration.

The present configuration of the apparatus 100 does not include the discharge tray 260 illustrated in FIG. 1 and the like. Alternatively, a conveyance guide that guides the sheets S from the accommodation portions 201 to 203 to the discharge tray 124 for forcibly discharging the sheets S accommodated in the accommodation portions 201 to 203 external to the body 103 of the apparatus is separately provided. FIG. 12 illustrates a cross-sectional view of the present configuration, and FIG. 13 illustrates a perspective view of the present configuration. Portions that are the same as those in FIG. 1 or 7 are denoted with the same reference numerals.

As illustrated in FIG. 12, the apparatus 100 includes a conveyance guide 254 that guides the sheets S accommodated in the accommodation portions 201 to 203 to the tray 124. The guide 254, midway, merges with a guide 122. Furthermore, the unit 200 includes a fourth switching member 253 that is capable of performing switching such that the sheets S moved from the accommodation portions 201 to 203 are conveyed to the opening portion 250 or to the guide 254. The unit 200 further includes a conveyance roller pair 252.

When the sheets S are exposed from the accommodation portions 201 to 203, the roller pairs 251 and 252 are each separated with an actuator (not shown). Furthermore, the switching member 253 is switched to a positon illustrated by a broken line in FIG. 12. The sheets S accommodated in the accommodation portions 201 to 203 are pushed out with the push out members 241 to 243 and are exposed from the opening portion 250.

On the other hand, when the sheets S are forcibly discharged from the accommodation portions 201 to 203, the switching member 253 is switched to a position illustrated by a solid line in FIG. 12. The discharged sheets S are pushed out with the push out members 241 to 243 until the front edges of the sheets S at least pass the abutment line of the roller pair 252. Subsequently, the sheets S come in contact with the roller pair 252 and are conveyed with the roller pair 252 and roller pairs provided in the guide 254. The sheets S pass the guide 122 and ultimately are discharged on the discharge tray 124.

As described above, by having the sheets S that has been forcibly discharged from the unit 200 to be discharged to the tray 124, there will be no need to provide a new tray 260 near the opening portion 250. By not providing the tray 260, an advantageous effect such as the user being capable of operating the cassette 106, the operation display unit 307, and the ID card reader 308 easily and the user being capable of accessing the sheets S exposed from the opening portion 250 easily is obtained. Configuration in which sheet accommodation unit 200 is optional.

Figure 14:
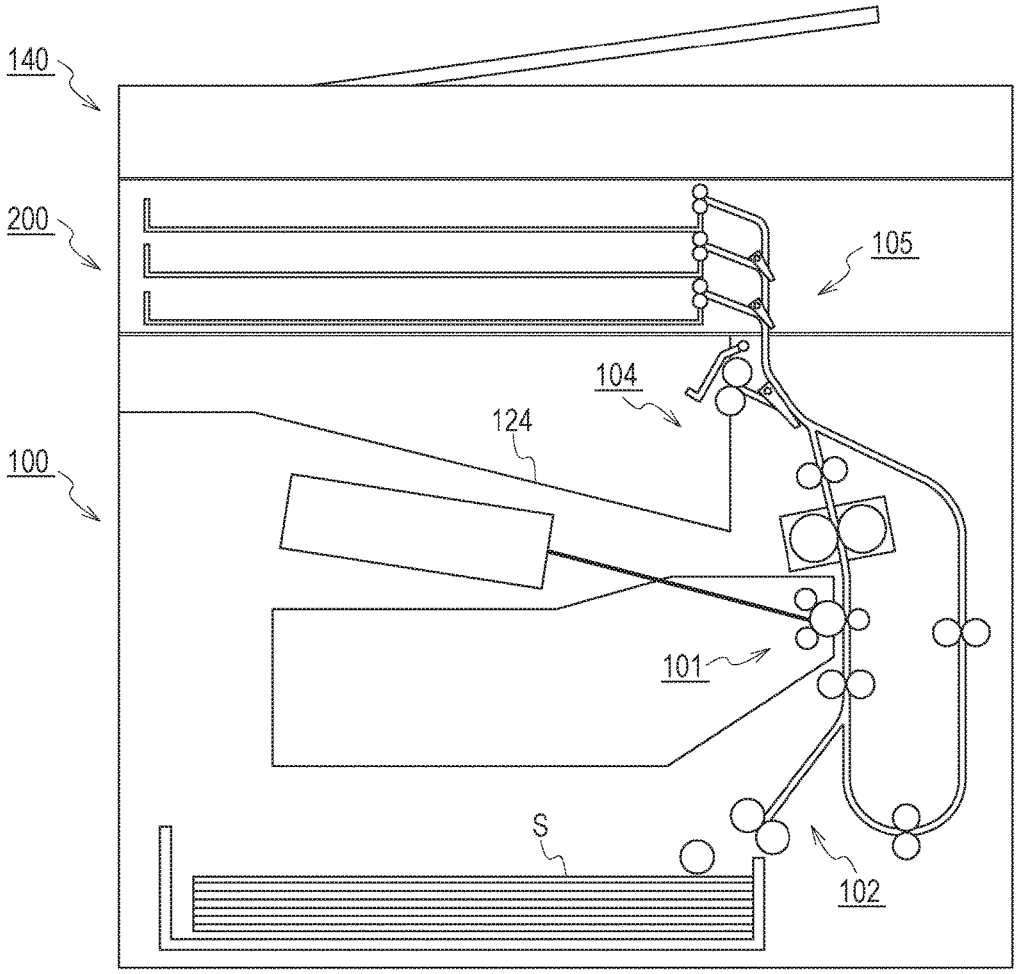
FIG. 14 is a cross-sectional view of an image forming apparatus and a sheet accommodation unit of the first and second exemplary embodiments having another apparatus configuration.
Figure 15:
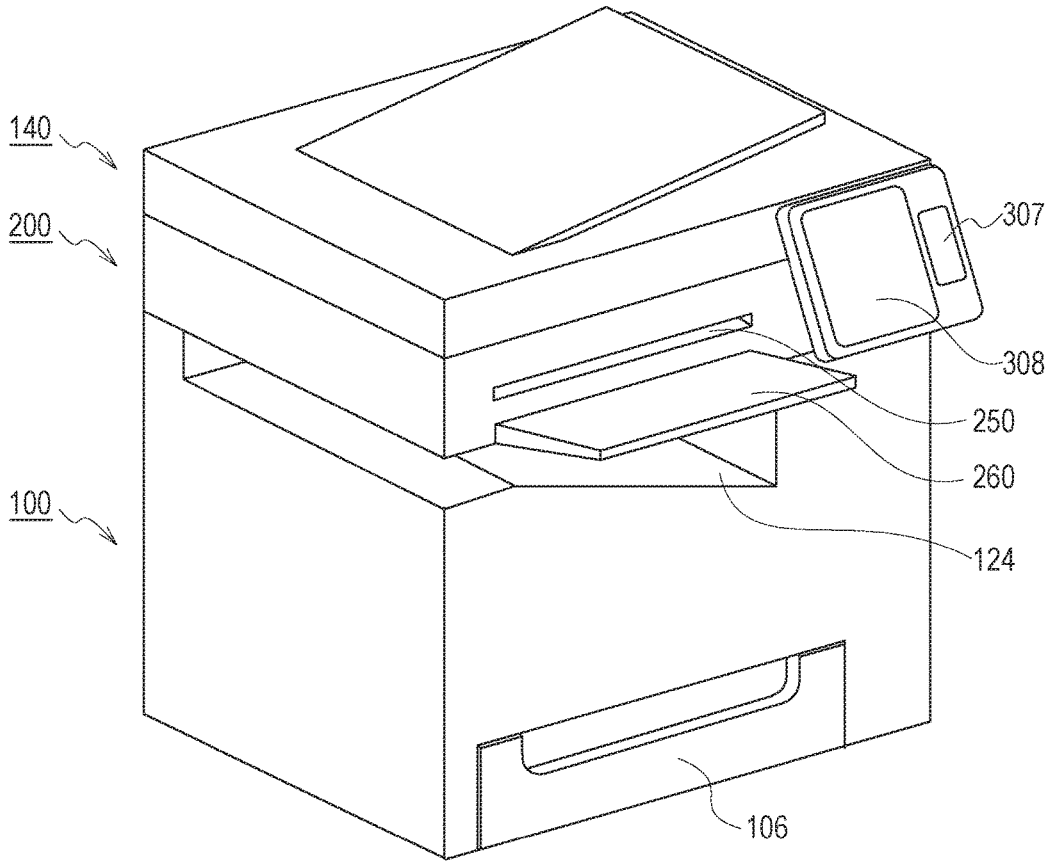
FIG. 15 is a perspective view of the image forming apparatus and the sheet accommodation unit of the first and second exemplary embodiments having the another apparatus configuration.

In the configuration described above, an example in which the sheet accommodation unit 200 is integrally configured with the image forming apparatus 100 has been described. In the present configuration, the unit 200 is an option and is provided on the apparatus 100 in a detachable state. FIG. 14 illustrates a cross-sectional view of the present configuration, and FIG. 15 illustrates a perspective view of the present configuration. Portions that are the same as those in FIG. 1 or 7 are denoted with the same reference numerals.

As illustrated in FIG. 14, the unit 200 is provided on the upper portion of the apparatus 100 in a detachable state. Furthermore, an original reader 140 is provided on the upper portion of the unit 200. Note that the original reader 140 may not be provided.

As illustrated in FIG. 15, the unit main body forms an opening portion 250. Note that a so-called side oriented configuration, in which the direction in which the sheet S is fed and the direction in which the sheet S is discharged are orthogonal to the direction in which the cassette 106 is drawn out, is illustrated. In the side oriented configuration, the sheet S is conveyed in the left-right direction when viewing the device from the front. It goes without saying that the present configuration may be a so-called front oriented configuration illustrated in FIG. 7, in which the direction in which the sheet S is fed and the direction in which the sheet S is discharged are the same as the direction in which the cassette 106 is drawn out. In the front oriented configuration, the sheet S is conveyed in the front-back direction when viewing the device from the front.

In the present configuration, a control unit provided in the apparatus 100 may control the operation of the unit 200. Furthermore, an independent control unit may be provided in the unit 200 and the control of the operation may be performed through communication with a control unit provided in the apparatus 100. Configuration in which sheet accommodated in sheet accommodation unit 200 can be moved in two directions In the configuration described above, the direction in which the sheets S accommodated in the accommodation portions 201 to 203 is moved is in only one direction. In the present configuration, the sheets S accommodated in the accommodation portions 201 to 203 can be moved in two directions that are orthogonal to each other. The configuration of each accommodation portion is the same and, herein, the configuration of the accommodation portion 201 will be mainly described with reference to FIGS. 16 to 19. FIGS. 16 to 19 are diagrams of the accommodation portion 201 viewed from above.

Figure 16:
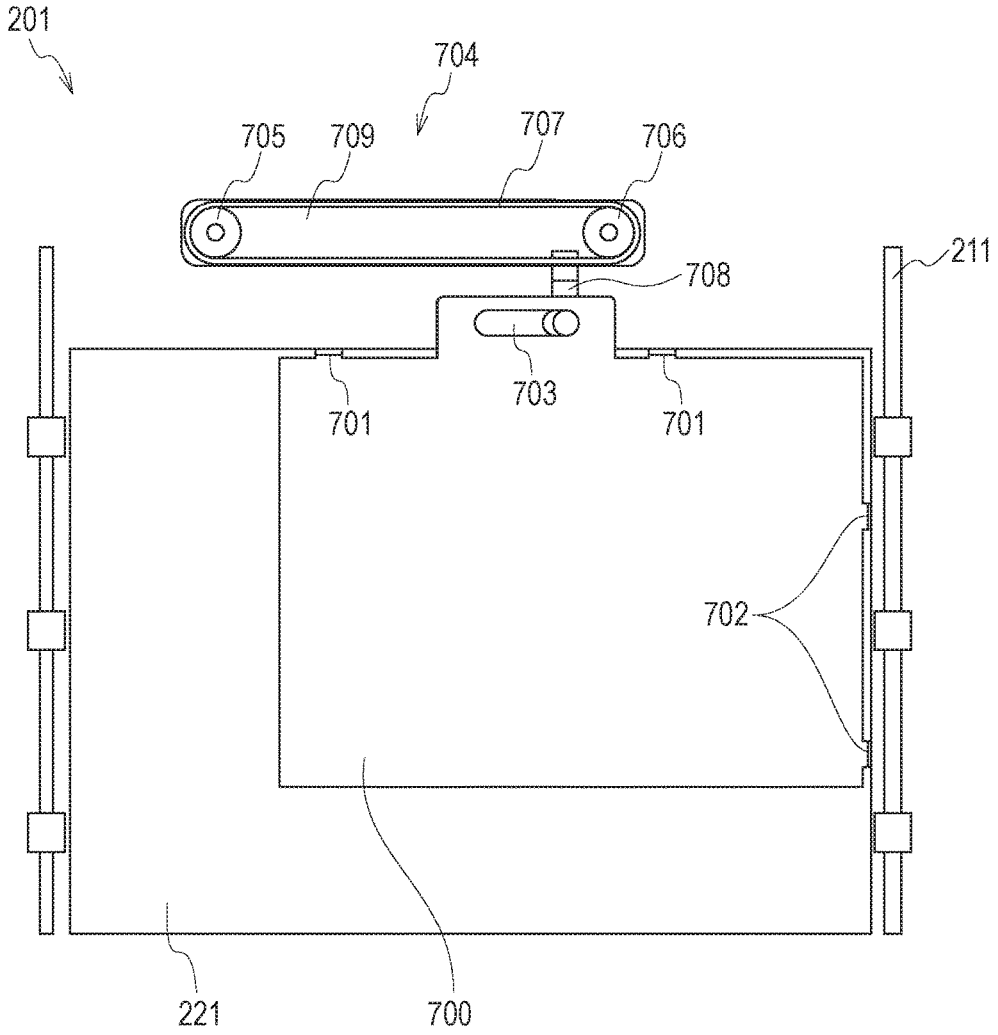
FIG. 16 is a top view of an accommodation portion of the first and second exemplary embodiments having the another apparatus configuration.

FIG. 16 illustrates a state in which no sheet S is accommodated in the accommodation portion 201. In FIG. 16, a movable tray 700 is provided on the stacking tray 221 in a movable state with respect to the tray 221. Furthermore, first push out claws 701 and second push out claws 702 are provided in the movable tray 700. Furthermore, an engagement hole 703 is formed in the movable tray 700.

A drive unit 704 includes a first pulley 705, a second pulley 706, an endless belt 707, a link member 708 that is fixed to the endless belt 707 in an integrated manner, and a base plate 709 including a connection portion that connects the shafts of the pulleys. Furthermore, the link member 708 is engaged with the engagement hole 703 described above. The endless belt 707 is driven by rotating the first pulley 705 with an actuator (not shown). Furthermore, the drive unit 704 is provided so as to be capable of being rotated with an actuator (not shown) about the first pulley 705 serving as an axis.

Figure 17:
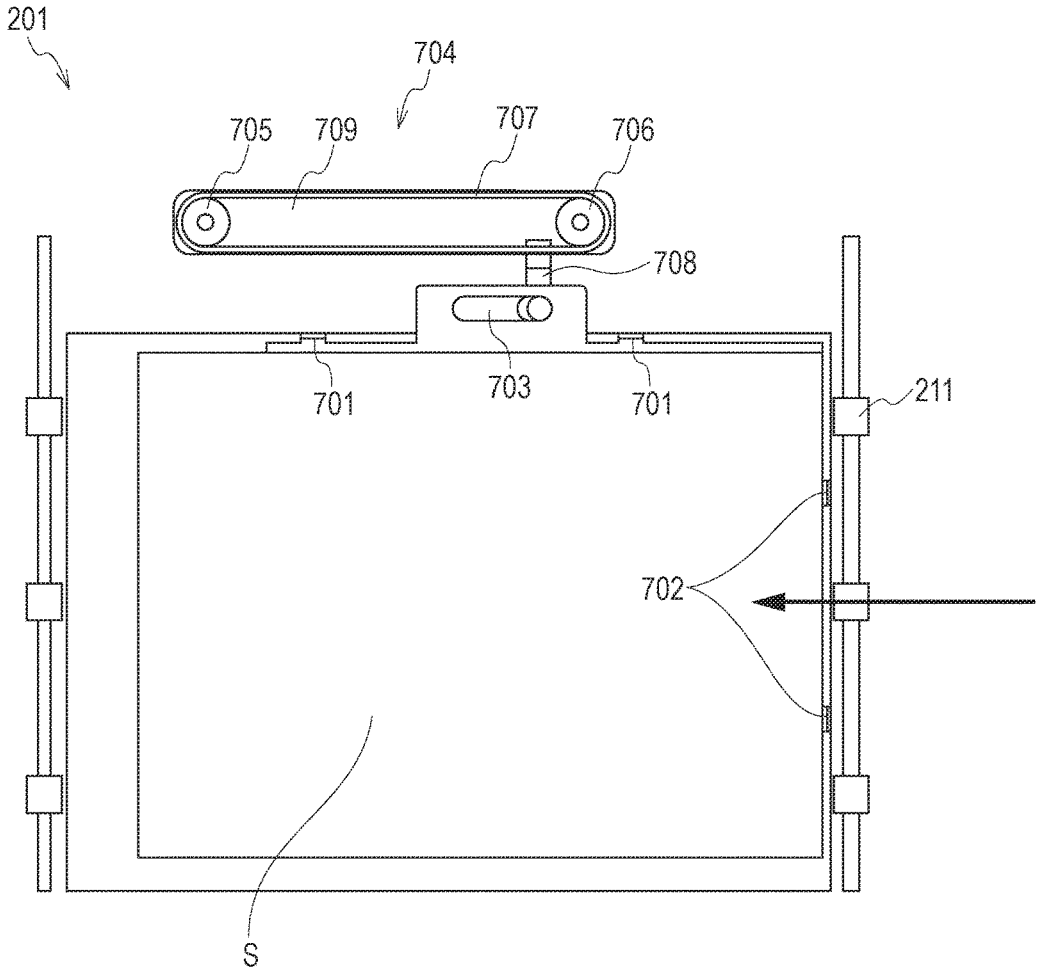
FIG. 17 is a top view of the accommodation portion of the first and second exemplary embodiments having the another apparatus configuration.

FIG. 17 illustrates a state in which sheets S are accommodated in the accommodation portion 201. The sheets S are conveyed in the arrow direction in FIG. 17 with the conveyance rollers 211 and are accommodated in the accommodation portion 201. At this point, the sheets S are placed on the movable tray 700.

Figure 18:
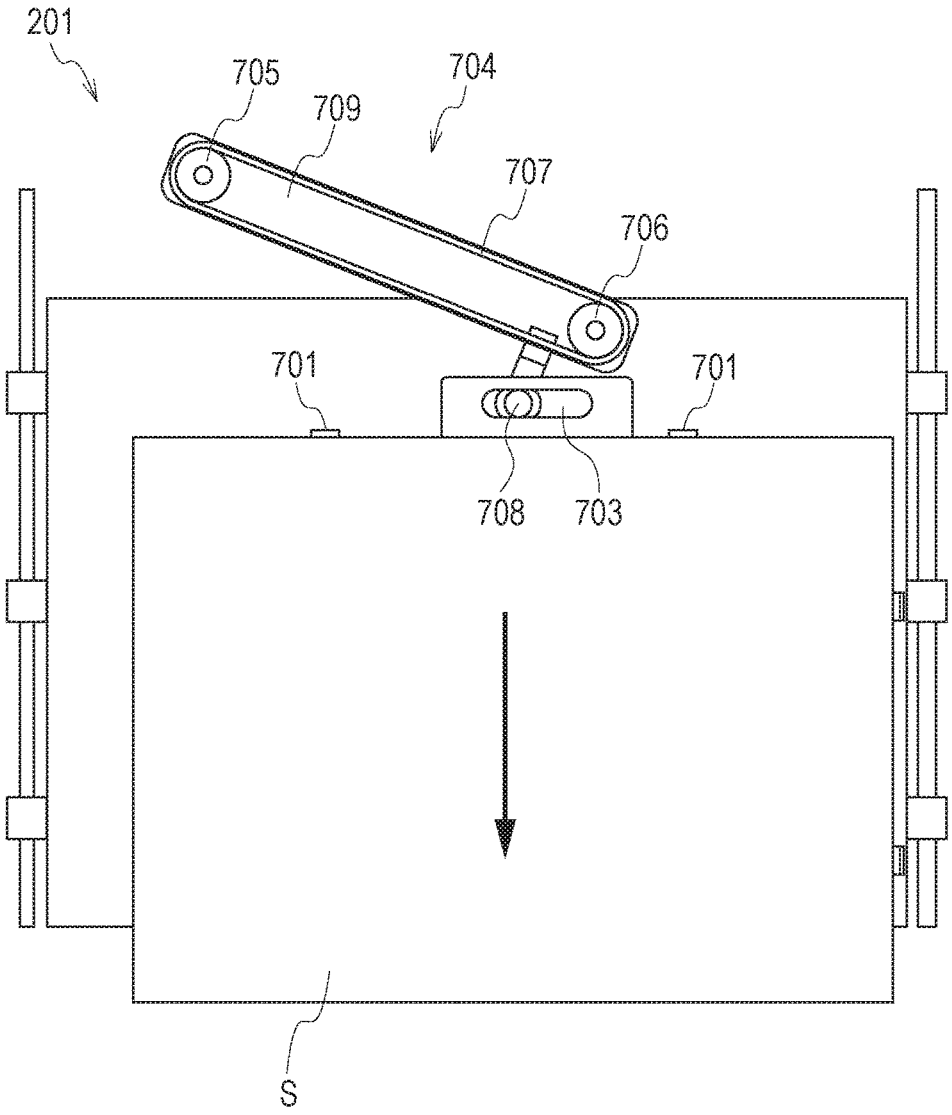
FIG. 18 is a top view of the accommodation portion of the first and second exemplary embodiments having the another apparatus configuration.

FIG. 18 is a diagram illustrating a state in which the sheets S are moved in a direction orthogonal to the direction in which the sheets S have been conveyed by the rollers 211. As illustrated in FIG. 18, the drive unit 704 is rotated in the clockwise direction from the state in FIG. 17 with the first pulley 705 serving as an axis. In the above, the endless belt 707 is fixed and the movable tray 700 is moved in the arrow direction while the link member 708 slides inside the engagement hole 703. With the above, the movable tray 700 is moved in the arrow direction in FIG. 18. Associated with the above, the sheets S are moved in the arrow direction in FIG. 18 with the first push out claws 701.

Figure 19:
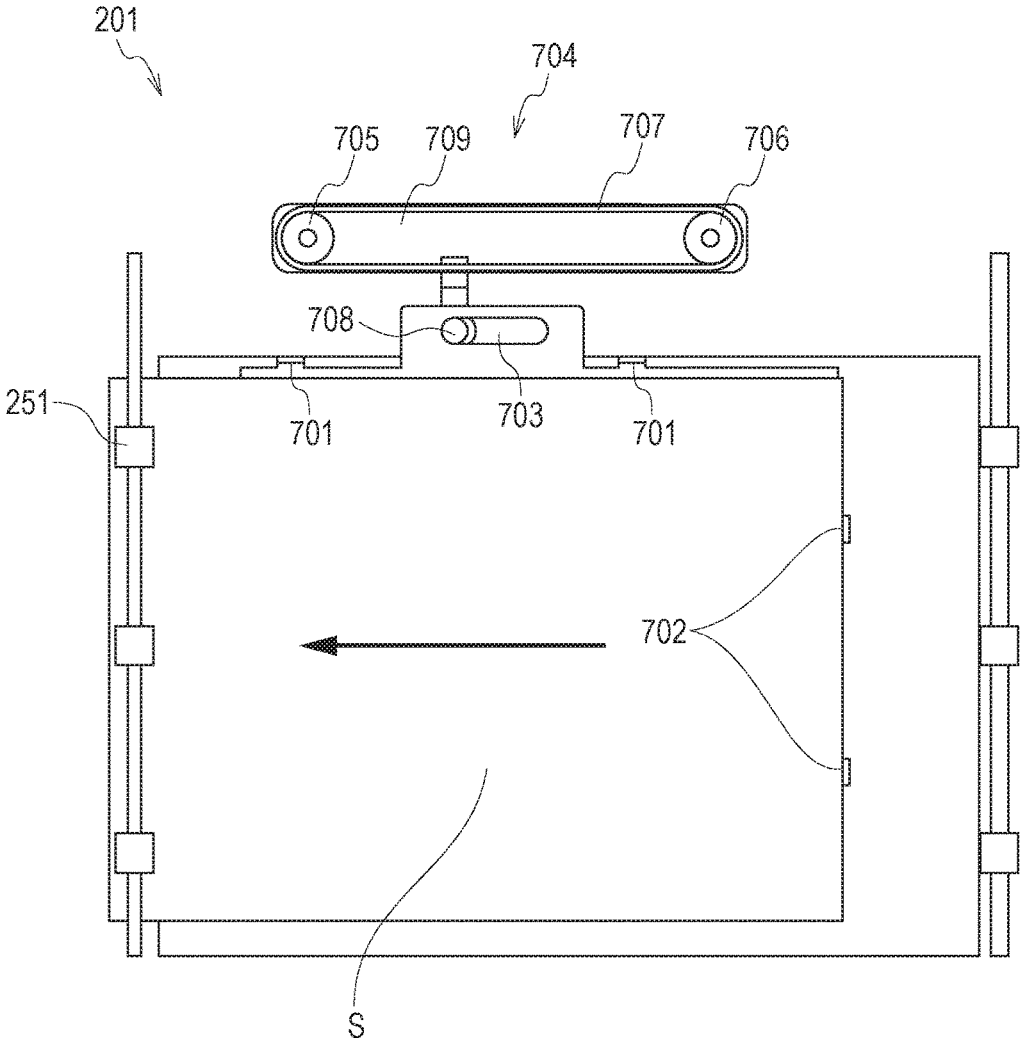
FIG. 19 is a top view of the accommodation portion of the first and second exemplary embodiments having the another apparatus configuration.

FIG. 19 is a diagram illustrating a state in which the sheets S are moved in a direction that is the same as the direction in which the sheets S have been conveyed by the rollers 211. As illustrated in FIG. 19, the endless belt 707 is rotated with an actuator (not shown) in the clockwise direction to move the sheets S in the arrow direction in FIG. 19. Associated with the above, the link member 708 fixed to the endless belt 707 in an integrated manner moves in the arrow direction. The link member 708 moves in the arrow direction inside the engagement hole 703. At this point, the movable tray 700 does not move. When the link member 708 moves further, the link member 708 abuts against the left end of the engagement hole 703 and, then after, the movable tray 700 moves in the arrow direction in accordance with the movement of the link member 708. Associated with the above, the sheets S are moved in the arrow direction in FIG. 19 with the second push out claws 702.

Note that when the movable tray 700 is moved, the rollers of the discharge roller pairs 251 are separated from each other. As illustrated in FIG. 19, after the sheets S are moved until the front edges of the sheets S pass the nip line of the discharge roller pairs 251, the discharge rollers 251 are abutted against the sheets S and are rotated; accordingly, the sheets S can be moved further.

Figure 20:
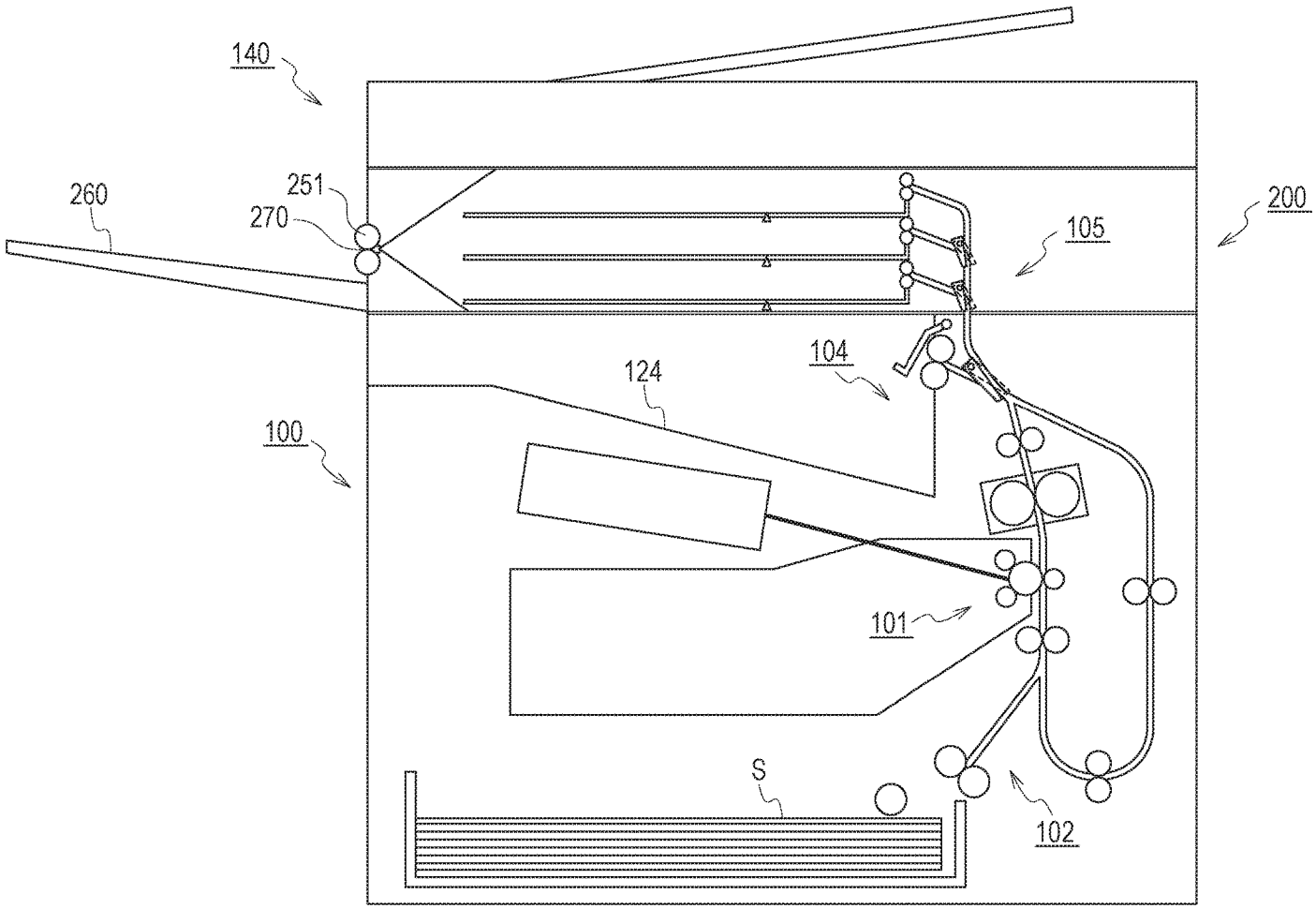
FIG. 20 is a cross-sectional view of an image forming apparatus and a sheet accommodation unit of the first and second exemplary embodiments having another apparatus configuration.
Figure 21:
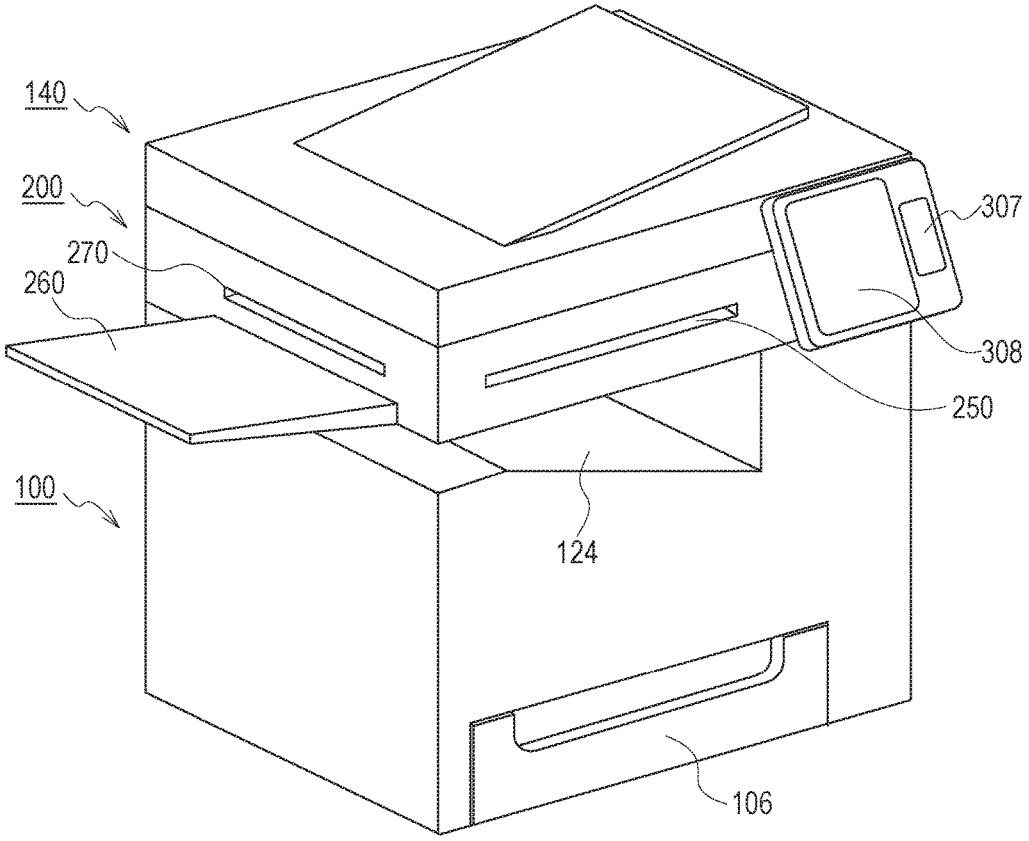
FIG. 21 is a perspective view of the image forming apparatus and the sheet accommodation unit of the first and second exemplary embodiments having the another apparatus configuration.

FIG. 20 illustrates a cross-sectional view of the present configuration, and FIG. 21 illustrates a perspective view of the present configuration. Portions that are the same as those in FIG. 14 or 15 are denoted with the same reference numerals. As illustrated in the figures, the opening portion 250 and an opening portion 270 is formed in the unit main body. The sheets S are exposed by the first push out claws 701 from the opening portion 250 described in FIG. 18. The sheets S are discharged by the second push out claws 702 and the discharge roller pairs 251 from the opening portion 270 described in FIG. 19. The discharge tray 260 for stacking the sheets S that have been forcibly discharged is provided near the opening portion 270.

As described above, by forcibly discharging the sheets S accommodated in the unit 200 from the opening portion 270 formed in the surface that is different from the surface in which the opening portion 250 is formed, there is no need to provide a tray 260 near the opening portion 250. By not providing any tray 260 near the opening portion 250, an advantageous effect such as the user being capable of operating the cassette 106, the operation display unit 307, and the ID card reader 308 easily and the user being capable of accessing the sheets S exposed from the opening portion 250 easily is obtained.

In the first and second exemplary embodiments described above, the configuration in which the conveyance path of the sheet merges downstream of the accommodation portions and in which there is only a single opening portion has been described; however, a plurality of opening portions may be separately provided. Furthermore, the sheets that are accommodated in each of the accommodation portions may be exposed from different opening portions.

In the configuration described in Japanese Patent Laid-Open No. 2014-114164, an opening portion is formed on the front side of the main body of the apparatus. Furthermore, an operation panel (an operation display unit) and an ID card reading portion for the user to issue a command or to input information to the image forming apparatus are provided on the front side of the main body of the apparatus in a similar manner. With the above configuration, since the sheets are exposed in front of the user that has issued an expose command of the sheets through the panel and the like, the sheets can be easily seen by and is convenient for the user.

However, for example, when a user is in the midst of changing the settings of the image forming apparatus through the panel provided on the front of the main body of the apparatus, a problem is caused if another user tries to issue an expose command of sheets through the ID card reading portion and take out the sheets from the accommodation portion. In other words, since the user who is changing the settings through the panel is at the front of the main body of the apparatus, it will be difficult for another user to take out the sheets exposed from the opening portion at the front.

A third exemplary embodiment enables the user to take out the sheet accommodated in the accommodation portion from the side that is easier to take out according to the state in which the device is accessed. Usability is improved with the above.

Hereinafter, an exemplary embodiment of the present disclosure will be described in detail with reference to the drawings.

Block Diagram of Image Forming Apparatus

Figure 22:
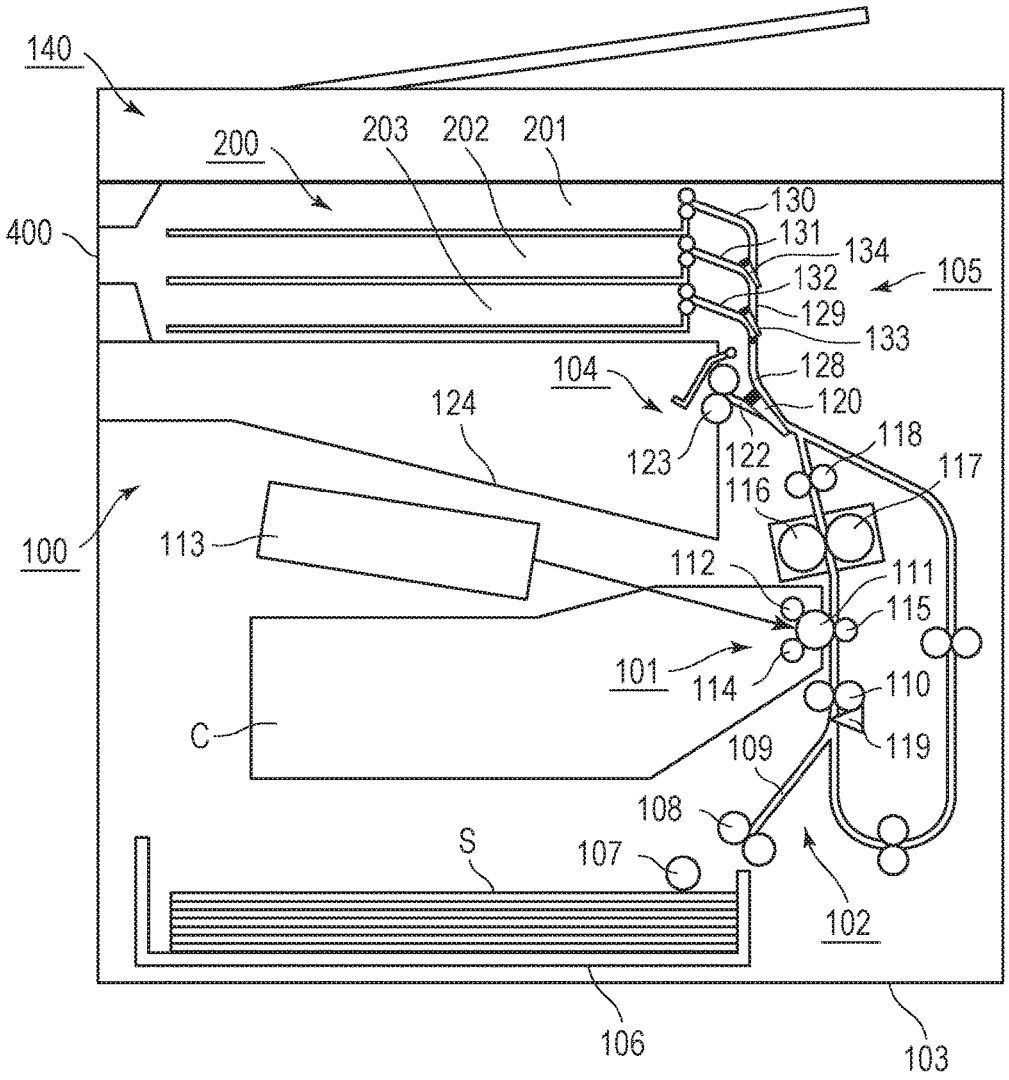
FIG. 22 is a cross-sectional view illustrating a configuration of an image forming apparatus according to a third exemplary embodiment.

FIG. 22 is a cross-sectional view illustrating a configuration of an image forming apparatus 100 including accommodation portions according to a third exemplary embodiment of the present disclosure. Note that in the present exemplary embodiment, a laser beam printer is illustrated as an example of the image forming apparatus.

The apparatus 100 includes an image forming unit 101, a supply unit 102 that supplies a sheet S to the image forming unit 101, a main body 103 (also referred to as a housing) of the apparatus, and a discharge unit 104 that discharges the sheet S on which an image has been formed with the image forming unit 101. Note that the sheet S is a sheet on which an image is formed with the image forming unit 101 and includes a piece of recording paper (plain paper, thick paper, or thin paper) or an OHP sheet, for example. Furthermore, the apparatus 100 includes a sheet accommodation unit 200 provided with a plurality of sheet accommodation portions 201 to 203 that temporarily accommodate sheets S on which images have been formed. The apparatus 100 includes a conveyance unit 105 that sorts and conveys the sheets S on which images have been formed to the accommodation portions 201 to 203 of the unit 200. An original reader 140 is provided on the upper portion of the unit 200. The original reader 140 is optional and may not be provided.

The image forming unit 101 includes a photosensitive drum 111 that rotates counterclockwise (in a CCW direction) in FIG. 22, a charge roller 112 that charges the surface of the drum 111, and an exposure unit 113 that forms an electrostatic latent image by irradiating the drum 111 with light. Furthermore, the image forming unit 101 includes a development unit 114 that adheres toner onto the electrostatic latent image and forms a toner image on the drum 111, and a transfer roller 115 that transfers toner image on the sheet S that has been conveyed. Furthermore, the image forming unit 101 includes a fixing roller 116, a pressure roller 117 that abuts against the roller 116, and a discharge roller 118, and fixes the toner image transferred onto the sheet S to the sheet S. The image forming unit 101 forms a toner image on the sheet S through the above electrophotographic image forming process.

Note that in the apparatus 100 of the present exemplary embodiment, the drum 111, the roller 112, the unit 114, and a toner accommodation portion (not shown) that accommodates toner are integrated as a cartridge C. The cartridge C is detachable with respect to the main body 103 of the apparatus. When there is no toner left in the cartridge C, the user can replace the cartridge C with a new cartridge C. With the above, the user can perform maintenance of the apparatus 100 without a service person. Furthermore, the present disclosure is not limited to such a cartridge type apparatus 100, and may be applied to an apparatus having a configuration in which members such as the drum 111, the roller 112, and the unit 114 are installed in the main body 103 of the apparatus (an apparatus in which the replacement of the components is not required).

The supply unit 102 includes a supply cassette 106 in which a plurality of sheets S used to form images are contained in a stacked state, a pickup roller 107, a feed roller 108, a conveyance guide 109, and a registration roller 110. Furthermore, a registration sensor 119 is provided near the roller 110. In response to the detection of the sensor 119 detecting the front edge of the conveyed sheet S, a timing to start forming an image with the image forming unit 101 is determined. The sensor 119 is constituted by a flag and a photo-interrupter (both not shown). The sensor 119 is configured so that an on/off signal is output from the photo-interrupter upon activation of the flag activated by the conveyed sheet.

The discharge unit 104 includes a first switching member 120, a discharge guide 122, a discharge roller 123, and a discharge tray 124 (a stack portion). The switching member 120 is capable of switching, with an actuator (not shown), between a position that guides the sheet S after image forming to the unit 200, and a position that guides the sheet S after image forming to the tray 124. The tray 124 is provided on an upper surface of the main body 103 of the apparatus and may be used and shared by a plurality of users. The sheet S is discharged on the tray 124 with the surface on which the image has been formed facing downwards (face-down).

The conveyance unit 105 includes a second switching member 133 and a third switching member 134 for switching the conveyance destination of the sheet S, and conveyance guides 128 to 132 that guides the sheets S to their respective accommodation portions 201 to 203. Note that the switching member 133 is capable of switching, with an actuator (not shown), between a position that guides the sheet S to the guide 129, and a position that guides the sheet S to the guide 132. The switching member 134 is capable of switching, with an actuator (not shown), between a position that guides the sheet S to the guide 130, and a position that guides the sheet S to the guide 131. Note that similar to the tray 124, the sheets S are accommodated in the accommodation portions 201 to 203 facedown.

Figure 23:
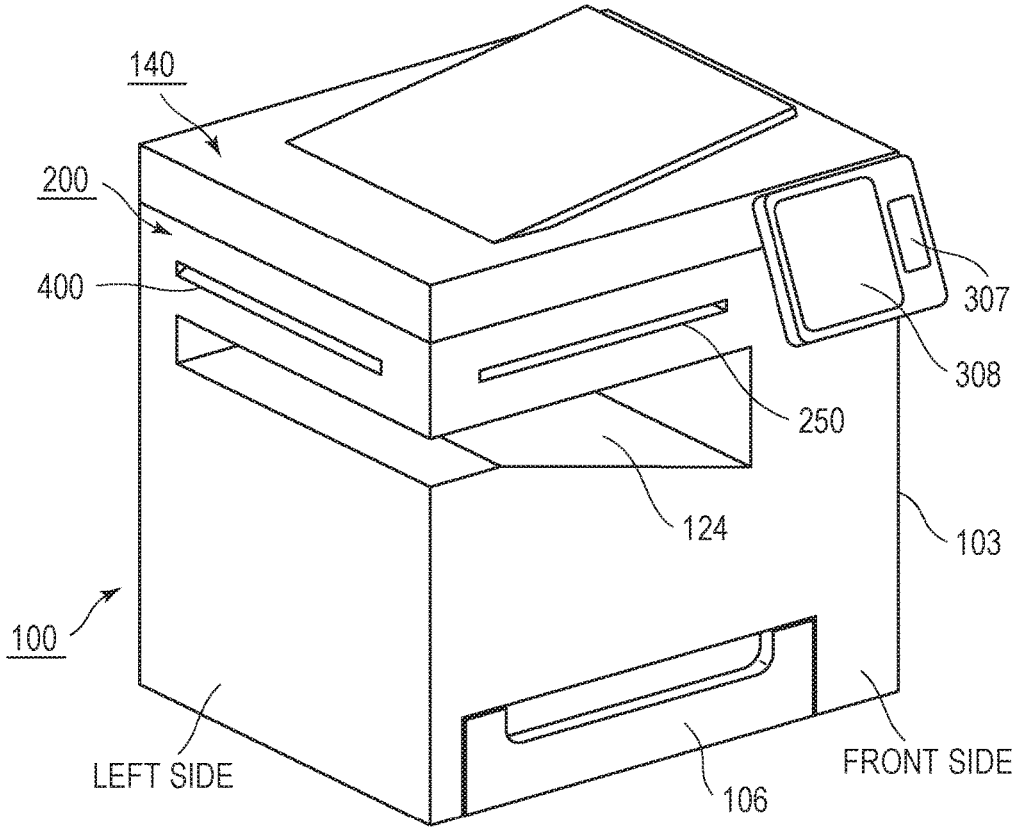
FIG. 23 is a perspective view illustrating a configuration of the image forming apparatus according to the third exemplary embodiment.

FIG. 23 is a cross-sectional view illustrating a configuration of the image forming apparatus 100. Note that in the apparatus 100 of the present exemplary embodiment, a so-called side oriented configuration, in which the direction in which the sheet S is fed and the direction in which the sheet S is discharged are orthogonal to the direction in which the cassette 106 is drawn out, is illustrated. In the side oriented configuration, the sheet S is conveyed in the left-right direction when viewing the device from the front.

An opening portion 250 is formed on the front side of the main body 103 of the apparatus. The sheets S that are accommodated in the accommodation portions 201 to 203 are exposed from the opening portion 250. In the unit 200, the conveyance paths of the sheets S merge into a single conveyance path at a portion between the accommodation portions 201 to 203 and the opening portion 250. Furthermore, an operation panel 307 (an operation display unit) for the user to issue a command or input information to the image forming apparatus is provided on the front side of the main body 103 of the apparatus. Furthermore, an ID card reading portion 308 for reading an ID card of the user is also provided on the front side of the main body 103 of the apparatus.

An opening portion 400 is formed on the left side with respect to the front side of the main body 103 of the apparatus viewed from the front. The sheets S that are accommodated in the accommodation portions 201 to 203 are exposed from the opening portion 400. As illustrated in FIG. 22, in the unit 200 of the apparatus, the conveyance paths of the sheets S merge into a single conveyance path at a portion between the accommodation portions 201 to 203 and the opening portion 400.

Block diagram of Sheet Accommodation Unit

Figure 24:
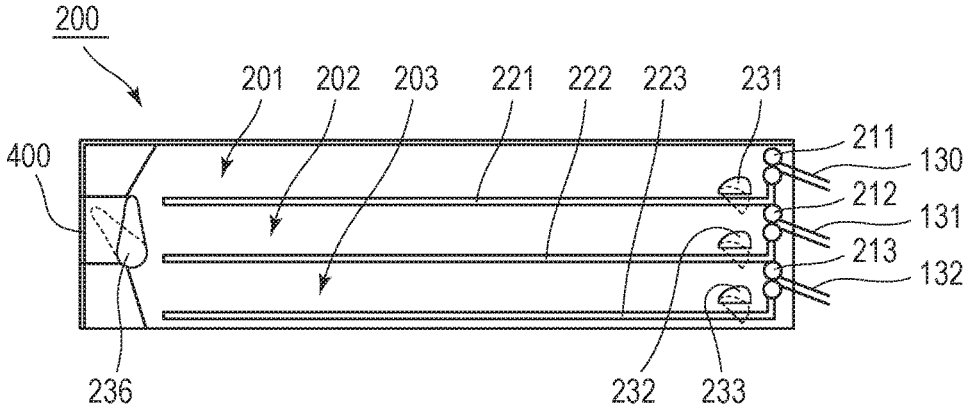
FIG. 24 is a cross-sectional view illustrating a configuration of a sheet accommodation unit according to the third exemplary embodiment.

FIG. 24 is a cross-sectional view illustrating a configuration of the unit 200. The cross section in FIG. 24 is the same cross section in FIG. 22. In the unit 200 of the present exemplary embodiment, the plurality of accommodation portions 201 to 203 are disposed so as to be stacked in the vertical direction. The configuration of each accommodation portion is the same and, herein, the configuration of the accommodation portion 201 will be mainly described.

The accommodation portion 201 includes conveyance rollers 211 for conveying the sheet S, a stacking tray 221 for stacking and temporarily accommodating the sheet S inside the main body 103 of the apparatus, and a sheet presence detection sensor 231 that detects whether a sheet S or sheets S are accommodated in the tray 221. Furthermore, the accommodation portion 201 includes a sheet push out member (a sheet moving member) that pushes the rear edge of the sheet S (the edge part of the sheet S on the upstream side in the moving direction) that is accommodated therein and that exposes a part of the accommodated sheet S external to the main body 103 of the apparatus. The sheet push out member is not shown in FIG. 24. Details of the sheet push out member will be described later. The push out member moves the sheet S to a position that the user can receive the sheet S, in other words, the push out member moves the sheet S until the front edge (the edge part of the sheet S on the downstream side in the moving direction) passes the opening portion 400. With the above, a predetermined length of the sheet S can be exposed external to the main body 103 of the apparatus. Note that the length in which the sheet S is exposed external to the main body 103 of the apparatus is set to 30 mm in the present exemplary embodiment. The above predetermined length is an example and any length that enables the user to take hold of the exposed sheet S and in which the sheet S is not greatly bent may be set.

Furthermore, the length of the tray 221 is set so that even if a sheet S with the maximum size that can be accommodated in the accommodation portion 201 is stacked, the front edge of the sheet S does not become exposed from the opening portion 400. When a sheet S is stacked on the tray 221 and the stacked sheet S pushes down the sensor 231 to the position depicted by a broken line, the sensor 231 is turned on. When the push out member moving the sheet S returns the sensor 231 to the position depicted by a solid line, the sensor 231 is turned off. Furthermore, when an opening portion sensor 236 that is disposed near the opening portion 400 is pushed to the position depicted by a broken line by the front edge of the moved sheet S, the sensor 236 is turned on. When the sheet S exposed external to the main body 103 of the apparatus is removed and the sensor 236 returns to the position depicted by a solid line, the sensor 236 is switched off from on. The distance in which the push out member is moved is determined by the length the sheet S is exposed and the size of the sheet S in the conveyance direction. The opening portion sensor 236 is provided near the opening portion 250 as well.

The configuration of the accommodation portion 202 and that of the accommodation portion 203 are the same as that of the accommodation portion 201. In other words, the accommodation portion 202 includes conveyance rollers 212, a stacking tray 222, a sheet presence detection sensor 232, and a sheet push out member (not shown). Furthermore, the accommodation portion 203 includes conveyance rollers 213, a stacking tray 223, a sheet presence detection sensor 233, and a sheet push out member (not shown).

FIGS. 25A to 25D are diagrams for describing an operation of the sheet push out member according to the present exemplary embodiment. In the present exemplary embodiment, the sheets S accommodated in the accommodation portions 201 to 203 can be moved in two directions that are orthogonal to each other. The operation of the sheet push out member of each accommodation portion is the same and, herein, description of the accommodation portion 201 will be mainly given. FIGS. 25A to 25D are top views of the accommodation portion 201. In each of the top views of FIGS. 25A to 25D, the side in which the opening portion 250 is provided is the front side in FIG. 23, and the side in which the opening portion 400 is provided is the left side in FIG. 23.

Figure 25A:
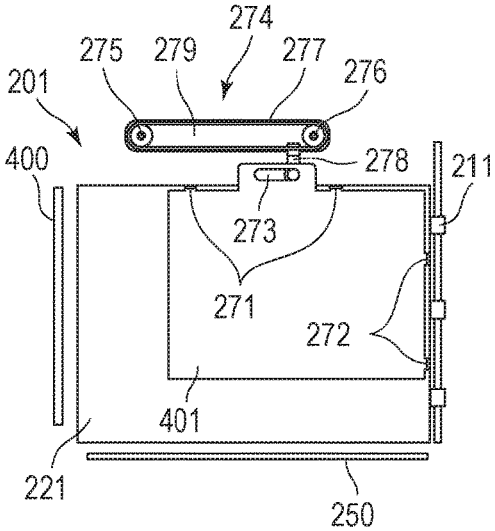
FIGS. 25A to 25D are diagrams for describing an operation of a sheet moving member according to the third exemplary embodiment.

FIG. 25A illustrates a state in which no sheet S is accommodated in the accommodation portion 201. In FIG. 25A, a movable tray 401 is provided on the stacking tray 221 in a movable state with respect to the tray 221. Furthermore, first push out claws 271 and second push out claws 272 are provided in the movable tray 401. The first push out claws 271 and the second push out claws 272 are capable of being in contact with the sheet S. Furthermore, an engagement hole 273 is formed in the movable tray 401.

A drive unit 274 includes a first pulley 275, a second pulley 276, an endless belt 277, a link member 278 that is fixed to the endless belt 277 in an integrated manner, and a base plate 279 including a connection portion that connects shafts of the pulleys. Furthermore, the link member 278 is engaged with the engagement hole 273 described above. The endless belt 277 is rotated by rotating the first pulley 275 with an actuator (not shown). Furthermore, the drive unit 274 is provided so as to be capable of being rotated with an actuator (not shown) about the first pulley 275 serving as an axis.

Figure 25C:
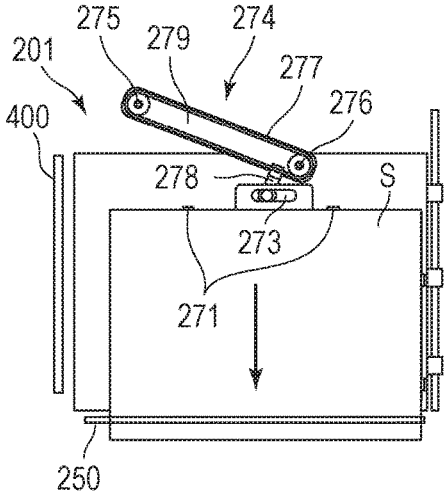
Figure 25B:
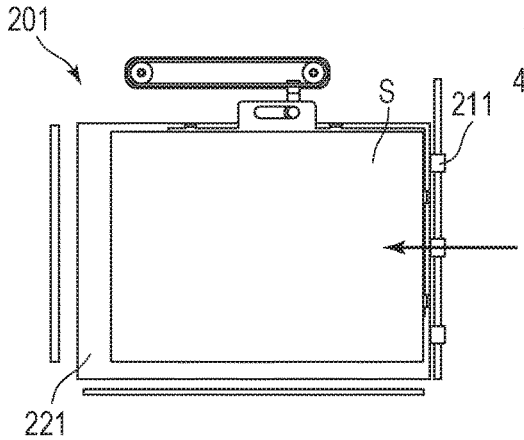

FIG. 25B illustrates a state in which sheets S are accommodated in the accommodation portion 201. The sheets S are conveyed in the arrow direction in FIG. 25B with the conveyance rollers 211 and are accommodated in the accommodation portion 201. At this point, the sheets S are placed on the movable tray 401.

FIG. 25C is a diagram illustrating a state in which the sheets S are moved towards the opening portion 250. As illustrated in FIG. 25C, the drive unit 274 is rotated in the clockwise direction (in the CW direction) from the state in FIG. 25B with the first pulley 275 serving as an axis. In the above, the endless belt 277 is fixed and the movable tray 401 is moved in the arrow direction while the link member 278 slides inside the engagement hole 273. With the above, the movable tray 401 is moved in the arrow direction in FIG. 25C. Associated with the above, the first push out claws 271 push the rear edges of the sheets S, and moves the sheets S in the arrow direction in FIG. 25C.

As in the above manner, a state in which portions of the sheets S are in the main body 103 of the apparatus and in which the sheets S are exposed from the opening portion 250 external to the main body 103 of the apparatus and are stopped thereat is defined as an exposed state. The user is capable of taking out only his/her own printed job all at once by pinching and pulling out the exposed sheet S. The opening portion sensor 236 is provided near the opening portion 250. When the user takes out the sheets S, the sensor 236 detects that the sheets S have been taken out, and the drive unit 274 and the movable tray 401 return to a home position illustrated in FIG. 25A.

Figure 25D:
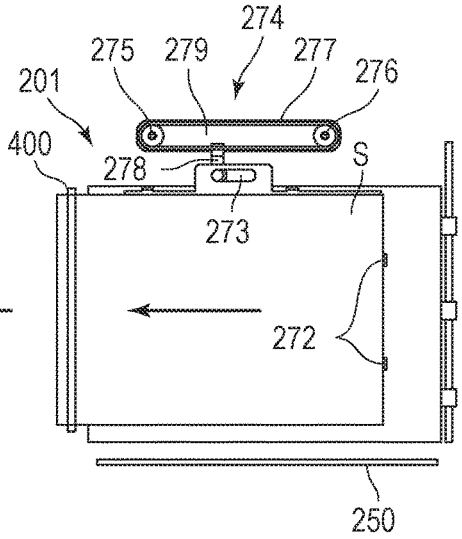

FIG. 25D is a diagram illustrating a state in which the sheets S are moved towards the opening portion 400. As illustrated in FIG. 25D, the endless belt 277 is rotated with an actuator (not shown) in the clockwise direction (in the CW direction) to move the sheets S in the arrow direction. Associated with the above, the link member 278 fixed to the endless belt 277 in an integrated manner moves in the arrow direction. The link member 278 moves inside the engagement hole 273 in the arrow direction. At this point, the movable tray 401 does not move. When the link member 278 moves further, the link member 278 abuts against the left end of the engagement hole 273 and, then after, the movable tray 401 moves in the arrow direction in accordance with the movement of the link member 278. Associated with the above, the second push out claws 272 push the rear edges of the sheets S, and moves the sheets S in the arrow direction in FIG. 25D.

As in the above manner, a state in which portions of the sheets S are in the main body 103 of the apparatus and in which the sheets S are exposed from the opening portion 400 external to the main body 103 of the apparatus and are stopped thereat is defined as an exposed state. The user is capable of taking out only his/her own printed job all at once by pinching and pulling out the exposed sheet S. The opening portion sensor 236 is provided near the opening portion 400. When the user takes out the sheets S, the sensor 236 detects that the sheets S have been taken out, and the drive unit 274 and the movable tray 401 return to the home position illustrated in FIG. 25A.

Block Diagram of Control Unit and Functional Components

Since a block diagram illustrating the control unit and the functional components according to the present exemplary embodiment is the same as that of the first exemplary embodiment illustrated in FIG. 4, description thereof is omitted. In the present exemplary embodiment, moving conditions are pieces of information on the distance in which the first push out claws 271 and the second push out claws 272 are moved to expose the sheet S from the opening portion 250, and the like.

Description of Operation of Sheet Accommodation Unit

In the apparatus 100 described above, the user is capable of selecting, with the external device 300 or the operation display unit 307, either one of a buffer mode in which the sheet S is temporarily accommodated in the unit 200 and a normal mode in which the sheet S is discharged to the tray 124. The above control is also the same as that of the first exemplary embodiment; accordingly, description thereof is omitted. In other words, the control that is the same as that described in the flowchart in FIG. 5 is executed.

Note that the periphery of the unit 200 other than where a conveyance opening (not shown) for conveying the sheets S and where the opening portion 250 and the opening portion 400 for exposing the accommodated sheets S are located is surrounded. Furthermore, a member surrounding the peripheral of the unit 200 is made of a non-transparent material. Accordingly, while the sheets S are accommodated in the accommodation portions 201 to 203, information printed on the sheets S in each accommodation portions 201 to 203 cannot be seen by the user. With the above, confidentiality of information can be increased since the information printed on the sheets S cannot be seen by other users.

Meanwhile, from the viewpoint of increasing confidentiality of information, there is an image forming apparatus that starts image forming after user authentication has been performed with an ID card and the like. However, different from such an apparatus, the apparatus 100 of the present exemplary embodiment only has to perform an operation of exposing the sheets s, on which images have been already formed, from the accommodation portions 201 to 203. Accordingly, without waiting while the images are formed after user authentication has been performed, the sheets S can be taken out quickly.

Furthermore, when the user commands the apparatus 100 to expose the sheets S, the user will be capable of only taking out his/her own sheet S. With the above, the user does not have to go through the trouble of finding his/her own sheets S from the tray 124 on which own sheets S and sheets of other users are mixed.

Figure 26:
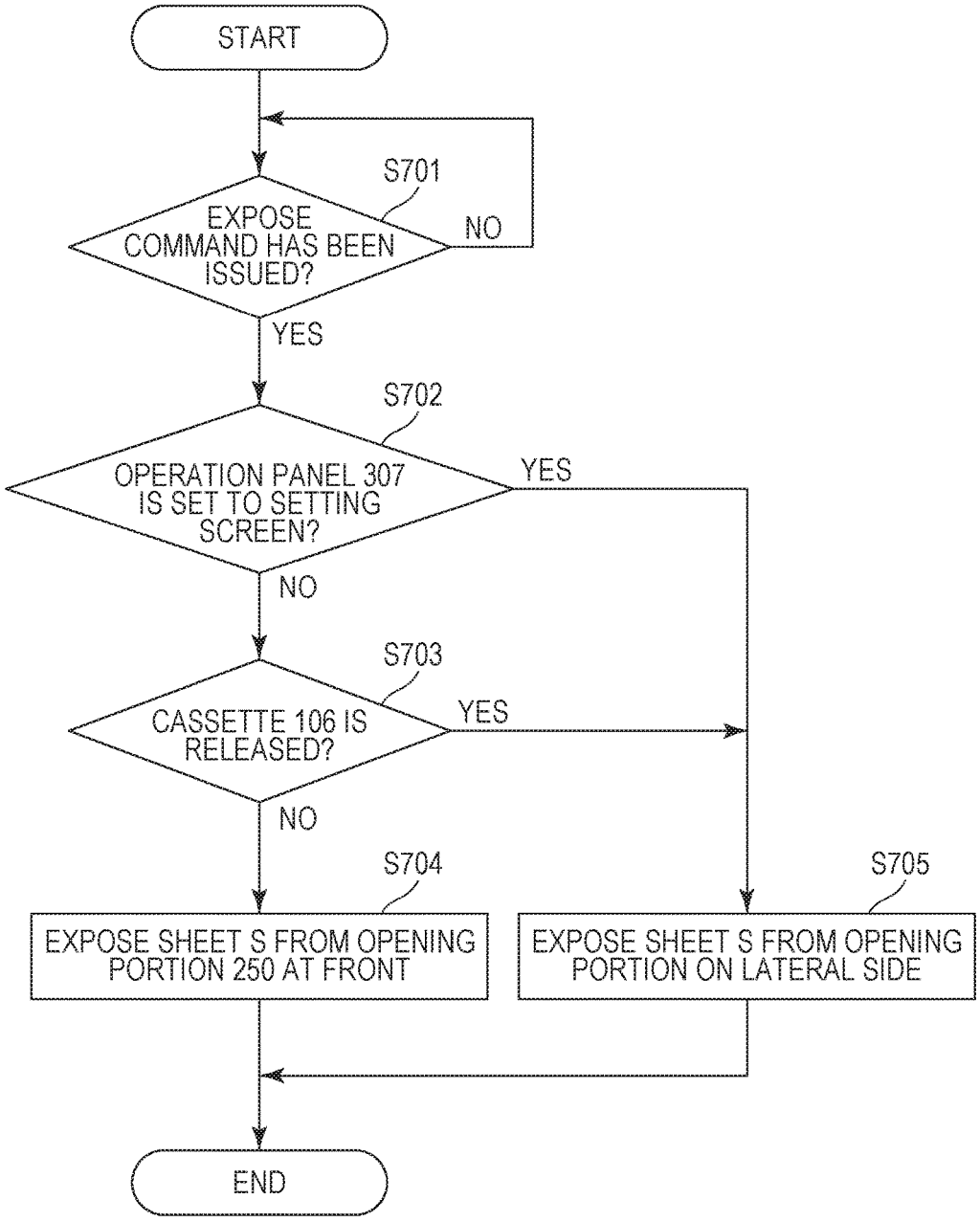
FIG. 26 is a flowchart for exposing the sheets, according to the third exemplary embodiment.

An operation performed when exposing the sheets S accommodated in the unit 200 in buffer mode external to the main body 103 of the apparatus from the opening portion 250 or the opening portion 400 will be described next. FIG. 26 is a chart illustrating a flow when the user commands exposure of the sheets S. Note that the control according to the flowchart is executed by the controller 302 and the like, illustrated in FIG. 4, based on the program stored in the memory 305.

First, when exposure of the sheets S is commanded in buffer mode, the expose command is issued to the controller 302 (S701). The controller 302 checks the state of the panel 307 and determines whether a setting screen for performing various settings of the apparatus 100 is displayed (S702). Note that the setting screen is different from the screen in which the expose command to the controller 302 can be issued by inputting the ID number, the password, and the like of the user. When the setting screen is displayed on the panel 307, the controller 302 moves the sheets S from the accommodation portion subject to the expose command, and exposes the sheets S from the opening portion 400 on the lateral side (S705). In other words, the sheets S are exposed from the lateral side of the main body 103 of the apparatus that is the side that is easier for other users to take out the sheets even when there is a user operating the panel 307 at the front of the main body 103 of the apparatus.

Conversely, when the setting screen is not displayed on the panel 307, the controller 302 determines whether the cassette 106 is released, in other words, the controller 302 determines whether the cassette 106 has been dismounted from the main body 103 of the apparatus (S703). Note that a sensor (not shown) that detects the release of the cassette 106 is provided in the apparatus 100 of the present exemplary embodiment, and the controller 302 performs the determination described above with the detection result of the sensor. When the cassette 106 has been released, the controller 302 moves the sheets S from the accommodation portion subject to the expose command, and exposes the sheets S from the opening portion 400 on the lateral side (S705). In other words, the sheets S are exposed from the lateral side of the main body 103 of the apparatus that is the side that is easier for other users to take out the sheets S even when there is a user releasing the cassette 106 and is adding sheets S or performing replacement at the front of the main body 103 of the apparatus.

Conversely, when the cassette 106 has not been released, the controller 302 moves the sheets S from the accommodation portion subject to the expose command, and exposes the sheets S from the opening portion 250 at the front (S704). In other words, when it is considered that there is no problem in exposing the sheets S at the front of the main body 103 of the apparatus, the sheets S are exposed at the front of the main body 103 of the apparatus that is easier for the user to see.

As described above, the present exemplary embodiment enables the user to take out the sheet accommodated in the accommodation portion from the side that is easier to take out according to the state in which the device is accessed.

In the exemplary embodiment described above, when the setting screen is displayed on the panel 307, or when the cassette 106 is released, the sheets S are exposed from the opening portion 400 on the lateral side. However, the two conditions described above are examples for determining whether there is an obstacle (in this case, the user who is accessing the panel 307 or the cassette 106) at the front of the main body 103 of the apparatus. Accordingly, for example, a sensor (not shown) that detects whether there is an object (including the user) around the apparatus 100 may be separately provided, and the side on which the sheet S is exposed may be switched according to the detection result of the sensor. Specifically, when there is an object near the front of the main body 103 of the apparatus, the sheets S are exposed from the lateral side of the main body 103 of the apparatus that is the side that is easier for the user to take out the sheets S.

Furthermore, in the present exemplary embodiment, as described above, actuators that drive the push out members are each provided for the corresponding accommodation portions 201 to 203. Accordingly, for example, it is possible to expose the sheets S accommodated in the accommodation portion 202 from the opening portion 400 while the sheets S accommodated in the accommodation portion 201 is exposed from the opening portion 250. Accordingly, the side on which the sheets S are exposed can be switched on the basis of the following conditions instead of switching the sides based on the flowchart in FIG. 26. In other words, at the point when the expose command is received, the controller 302 determines, using the sensor 236, whether the sheets S are exposed from the opening portion 250. When the sheets S are exposed from the opening portion 250, the sheets S are exposed from the opening portion 400 that is different from the opening portion 250. Furthermore, the opposite of the above can be performed in a similar manner.

Furthermore, in the third exemplary embodiment described above, the panel 307, the ID card reading portion 308, and the cassette 106 are provided at the front of the main body 103 of the apparatus. However, the present disclosure is not limited to the above. The above members may be provided on the lateral side of the main body 103 of the apparatus. In such a configuration, when the setting screen is displayed on the panel 307, it can be considered that the user who is operating the panel 307 is positioned at the lateral side of the main body 103 of the apparatus. Accordingly, the sheets S are exposed at the front of the main body 103 of the apparatus that is the side that is easier for the other users to take out the sheets S. In other words, the sheets S are exposed from the side that is different from the side on which the panel 307 and the cassette 106 are disposed.

Furthermore, in the third exemplary embodiment described above, a configuration in which the sheets S accommodated in the accommodation portions 201 to 203 are moved in two directions that are orthogonal to each other has been described. However, the directions in which the sheets S are moved do not necessarily have to be orthogonal with respect to each other and may be any directions that intersect each other.

Figure 27:
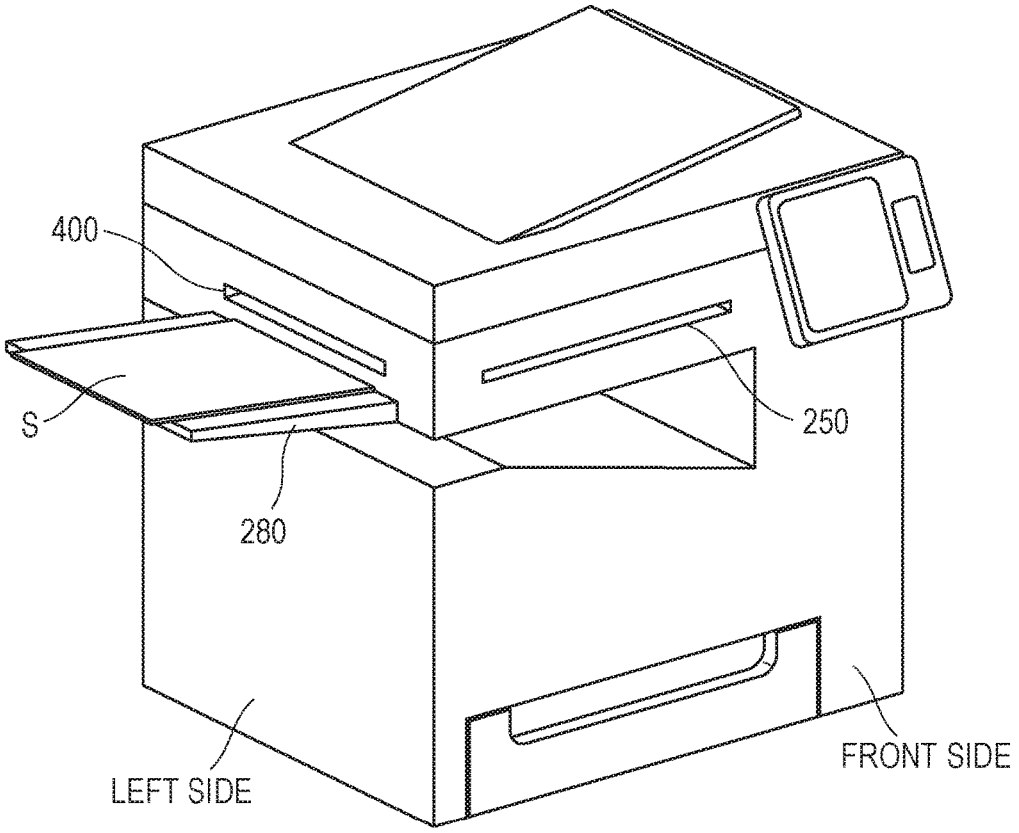
FIG. 27 is a perspective view illustrating a configuration of the image forming apparatus according to the third exemplary embodiment having another apparatus configuration.
Figure 28:
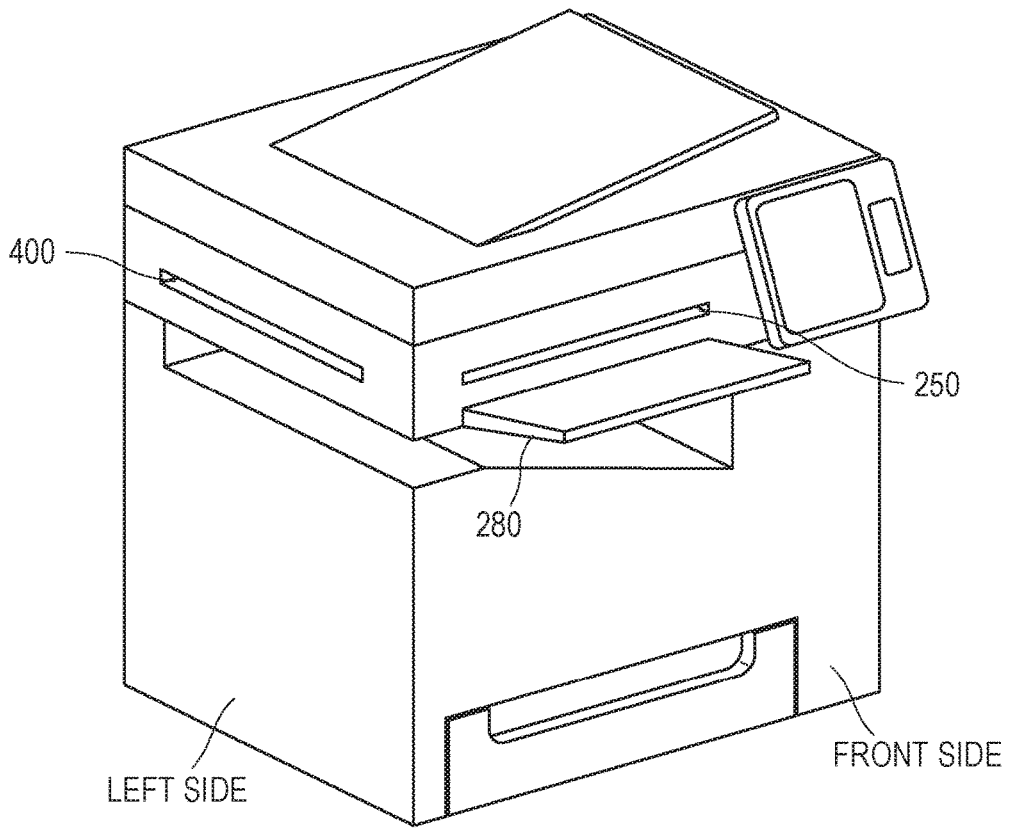
FIG. 28 is a perspective view illustrating a configuration of the image forming apparatus according to the third exemplary embodiment having another apparatus configuration.
Figure 29:
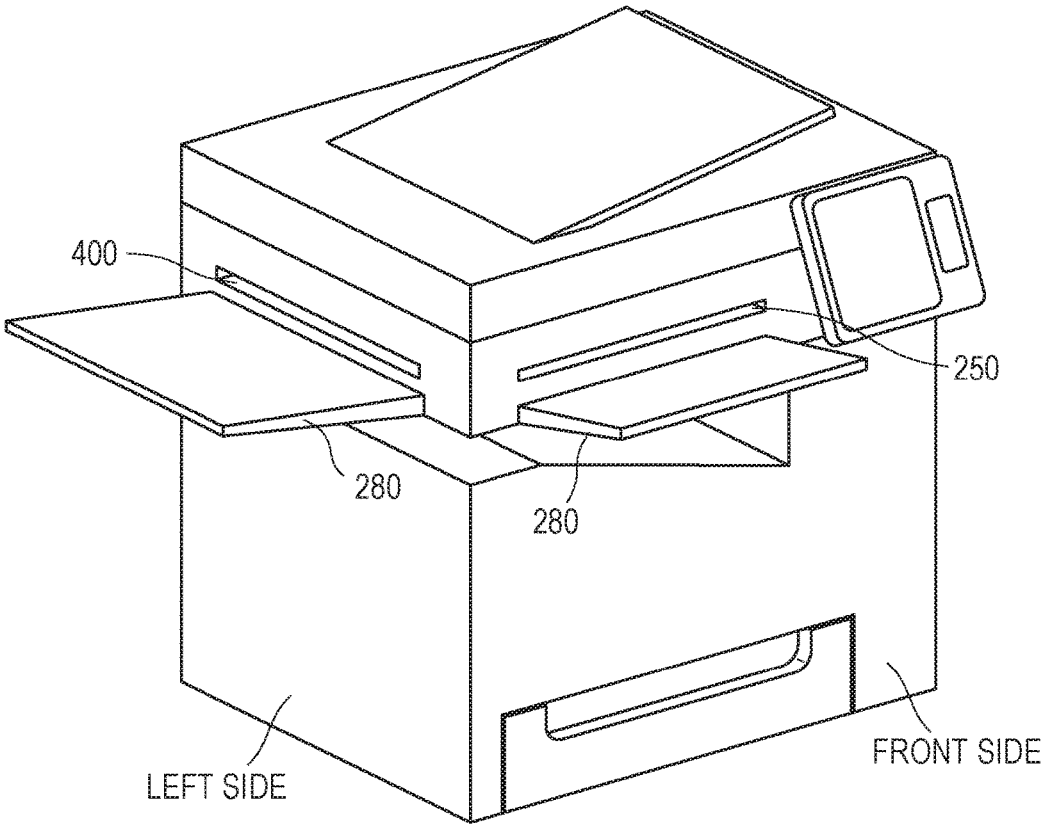
FIG. 29 is a perspective view illustrating a configuration of the image forming apparatus according to the third exemplary embodiment having another apparatus configuration.

Furthermore, in the third exemplary embodiment described above, portions of the sheets S are exposed external to the apparatus 100 from the opening portion 250 or the opening portion 400 according to the command of the user. However, the present disclosure is not limited to the above. As illustrated in FIG. 27, for example, a discharge tray 280 may be provided near the opening portion 400, and the sheet moving member moving the sheet S may discharge all of the sheets S to the tray 280. Furthermore, the discharge tray 280 may be provided near the opening portion 250 (FIG. 28) or may be provided near each of the opening portions 250 and 400 (FIG. 29).

Figure 30:
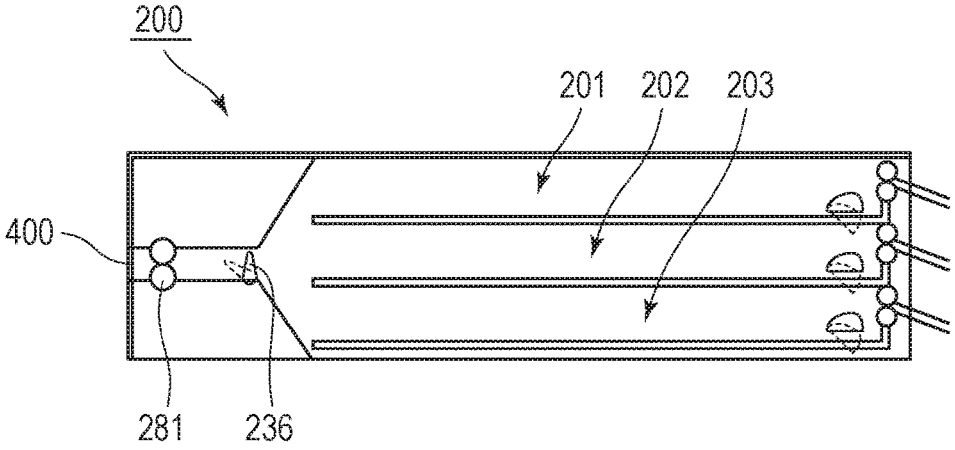
FIG. 30 is a cross-sectional view illustrating a configuration of a sheet accommodation unit according to the third exemplary embodiment having another apparatus configuration.

A configuration in which all of the sheets S are discharged to the tray 280 from the opening portion 400 will be described in detail now. FIG. 30 is a cross-sectional view illustrating a configuration of the unit 200. The configuration in FIG. 30 is different from the configuration in FIG. 24 in that discharge roller pairs 281, in which the rollers of each discharge roller pairs are capable of abutting against or separated from each other with an actuator (not shown), are disposed immediately upstream of the opening portion 400. FIG. 30 illustrates a state in which the rollers of each roller pair 281 are abutted against each other. When the sheets S are moved with the push out member and are exposed from the opening portion 400, the rollers of each roller pair 281 are separated from each other.

Figure 31:
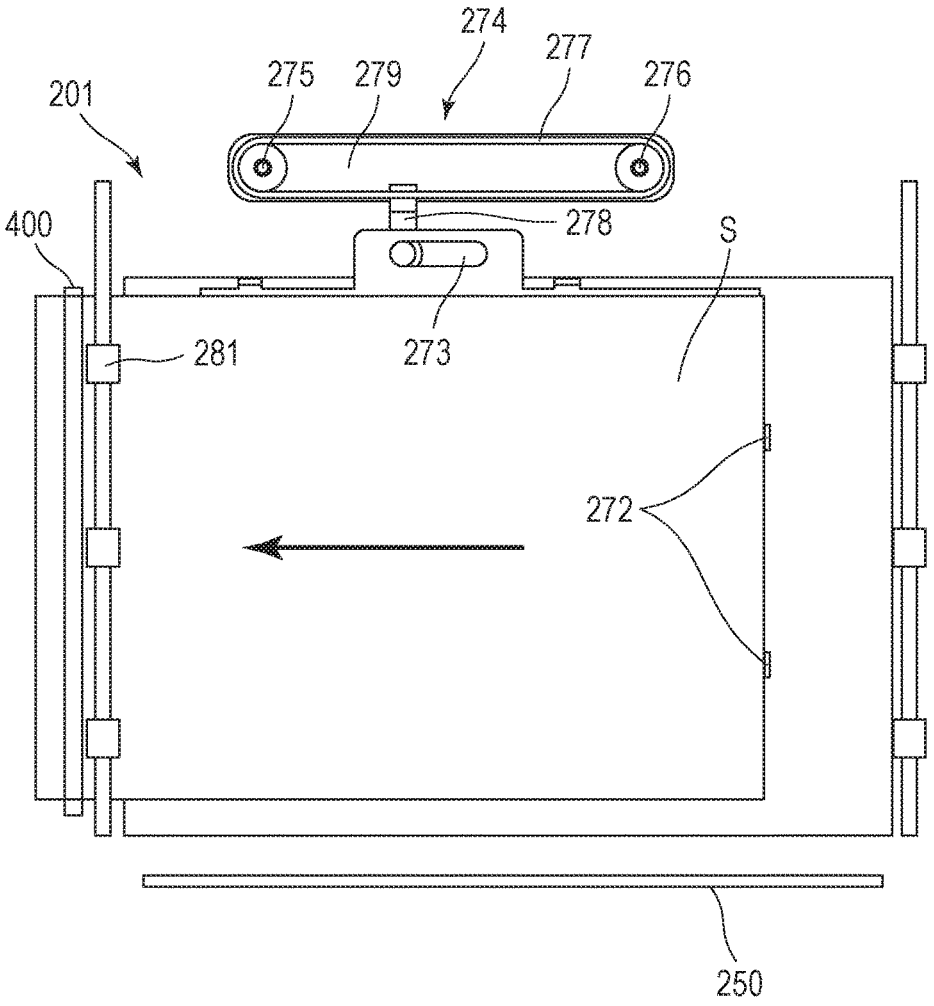
FIG. 31 is a diagram for describing an operation of a sheet moving member according to the third exemplary embodiment having another apparatus configuration.

Similar to FIG. 25D, FIG. 31 is a diagram illustrating a state in which the sheets S are moved towards the opening portion 400. Note that when the movable tray 401 is moved, the rollers of the discharge roller pairs 281 are separated from each other. As illustrated in FIG. 31, after the sheets S are moved until the front edges of the sheets S pass the nip line of the discharge roller pairs 281, the discharge rollers 281 are abutted against the sheets S and are rotated; accordingly, the sheets S can be moved further. With the above configuration, the sheets S can be discharged to the external tray 280.

Furthermore, in the third exemplary embodiment described above, a configuration in which the conveyance path of the sheet merges downstream of the accommodation portions and where there is only a single opening portion in each of the front side and the lateral side has been described. In another exemplary embodiment, a plurality of opening portions can be separately provided. Furthermore, the sheets that are accommodated in each of the accommodation portions can be exposed from different opening portions.

Furthermore, in the third exemplary embodiment described above, an example in which the sheet accommodation unit 200 is integrally configured with the image forming apparatus 100 has been described. In another exemplary embodiment, the sheet accommodation unit 200 can be provided in a detachable state with respect to the image forming apparatus 100. In such a case, a control unit provided in the image forming apparatus 100 controls the operation of the sheet accommodation unit 200. An independent control unit can be provided in the sheet accommodation unit 200 and the control of the operation performed through communication with a control unit provided in the image forming apparatus 100. In such a configuration, the opening portion 250 and the opening portion 400 are formed in the unit main body.

Modification

In the first to third exemplary embodiments described above, since an individual actuator is provided for the sheet push out member of each accommodation portion, by driving the actuators all at once, the sheets accommodated in the plurality of accommodation portions can be exposed in a stacked manner. In another exemplary embodiment, the number of provided actuators may be less than the number of accommodation portions. For example, a drive transmission switching member, such as a clutch (not shown), may be provided so that a single actuator selectively moves a plurality of sheet push out members.

Furthermore, in the first to third exemplary embodiments described above, the memory 305 is provided in the controller 302. However, the memory 305 may be provided in the engine control unit 303, the sheet accommodation unit control unit 304, or independently provided inside the image forming apparatus control unit 301. Furthermore, in the exemplary embodiments described above, while the controller 302 determines which accommodation portion conveys the sheets S and which accommodation portion exposes the sheets S, the determination may be made by another control unit, such as the engine control unit 303 or the sheet accommodation unit control unit 304.

Furthermore, in the first to third exemplary embodiments, various controls are divided and executed by the engine control unit 303 and the sheet accommodation unit control unit 304. In another exemplary embodiment, just the engine control unit 303 can execute the various controls. In such a case, the engine control unit 303 controls the conveyance unit 105 and the sheet accommodation unit 200.

Furthermore, in the first to third exemplary embodiments described above, description of a configuration in which three accommodation portions are provided has been provided. However, the number of the accommodation portion is not limited to that described above. The number of accommodation portions may be set according to the environment in which the image forming apparatus 100 is used, the number of users that share and use the image forming apparatus 100, or the specification of the image forming apparatus 100.

Furthermore, in the first to third exemplary embodiments described above, a laser beam printer has been illustrated as an example. The image forming apparatus to which the present disclosure is applied is not limited to a laser beam printer, and may be any type of printer adopting another printing method, such as an ink jet printer, or may be a copier.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

What is claimed is:

1. An image forming apparatus comprising:

a main body of the image forming apparatus including an opening portion;

an image forming unit that forms an image on a sheet;

an accommodation portion that accommodates, inside the main body of the image forming apparatus, the sheet on which the image has been formed with the image forming unit;

a stack portion that stacks the sheet discharged external to the main body of the image forming apparatus;

a sheet moving unit that moves the sheet accommodated in the accommodation portion; and a control unit that controls switching between a first mode that moves, with the sheet moving unit, the sheet accommodated in the accommodation portion and stops the sheet when a part of the sheet is exposed external to the main body of the image forming apparatus from the opening portion, and a second mode that moves, with the sheet moving unit, the sheet accommodated in the accommodation portion without passing the sheet through the opening portion in which the sheet is exposed in the first mode and discharges the sheet to the stack portion.

2. The image forming apparatus according to claim 1, wherein the control unit moves a first sheet with the sheet moving unit in the first mode when receiving a first sheet move command while in a state where the first sheet is accommodated in the accommodation portion, and wherein the control unit moves the first sheet with the sheet moving unit in the second mode when receiving an accommodation command of accommodating a second sheet in the accommodation portion while in the state where the first sheet is accommodated in the accommodation portion.

3. The image forming apparatus according to claim 2, wherein the control unit does not move the first sheet with the sheet moving unit in the second mode when, at a timing where the accommodation command has been received, a predetermined period of time has not elapsed since the first sheet was accommodated in the accommodation portion, and wherein the control unit moves the first sheet with the sheet moving unit in the second mode when, at the timing, the predetermined period of time has elapsed since the first sheet was accommodated in the accommodation portion.

4. The image forming apparatus according to claim 2, wherein, after the first sheet is moved in the second mode, the second sheet is accommodated in the accommodation portion.

5. The image forming apparatus according to claim 1, wherein the control unit moves a first sheet with the sheet moving unit in the first mode when receiving a first sheet move command while in a state where the first sheet is accommodated in the accommodation portion, and wherein the control unit moves the first sheet with the sheet moving unit in the second mode when a predetermined period of time has elapsed while in the state where the first sheet is accommodated in the accommodation portion.

6. The image forming apparatus according to claim 1, further comprising:

a conveyance unit that conveys the sheet on which the image has been formed with the image forming unit to the stack portion without passing the accommodation unit;

a first conveyance guide that guides the sheet on which the image has been formed with the image forming unit to the stack portion; and a second conveyance guide that guides the sheet accommodated in the accommodation portion to the stack portion, wherein the second conveyance guide merges the first conveyance guide.

7. The image forming apparatus according to claim 1, further comprising a conveyance guide that guides the sheet accommodated in the accommodation portion to the stack portion, wherein the conveyance guide is located between the accommodation portion and the stack portion in a vertical direction.

8. A sheet accommodation unit in an image forming apparatus that forms an image on a sheet, the sheet accommodation unit comprising:

a unit main body including an opening portion;

an accommodation portion that accommodates, inside the unit main body, the sheet on which the image has been formed;

a stack portion that stacks the sheet discharged external to the unit main body;

a sheet moving unit that moves the sheet accommodated in the accommodation portion; and a control unit that controls switching between a first mode that moves, with the sheet moving unit, the sheet accommodated in the accommodation portion and stops the sheet when a part of the sheet is exposed external to the unit main body from the opening portion, and a second mode that moves, with the sheet moving unit, the sheet accommodated in the accommodation portion without passing the sheet through the opening portion in which the sheet is exposed in the first mode and discharges the sheet to the stack portion.

* * * * *